US005125208A

United States Patent [19]

Tsukada et al.

[11] Patent Number: 5,125,208

[45] Date of Patent: * Jun. 30, 1992

[54] APPARATUS FOR SEAMING CAN END

[75] Inventors: Shinichi Tsukada; Tsutomu Shinomiya; Shigeki Yoshioka; Makoto Fujikawa, all of Iwatsuki, Japan

[73] Assignee: Hokkai Can Co., Ltd., Tokyo, Japan

[ * ] Notice: The portion of the term of this patent subsequent to May 14, 2008 has been disclaimed.

[21] Appl. No.: 507,779

[22] Filed: Apr. 12, 1990

[30] Foreign Application Priority Data

| | | | |
|---|---|---|---|
| Apr. 13, 1989 | [JP] | Japan | 1-94434 |
| Apr. 18, 1989 | [JP] | Japan | 1-96287 |
| Apr. 20, 1989 | [JP] | Japan | 1-45671[U] |
| Jun. 26, 1989 | [JP] | Japan | 1-160905 |
| Nov. 9, 1989 | [JP] | Japan | 1-289935 |

[51] Int. Cl.[5] ..... B65B 7/28

[52] U.S. Cl. ..... 53/366; 53/282; 53/284.5; 53/308; 74/422; 413/6; 413/52

[58] Field of Search ..... 53/282, 284.5, 308, 53/366; 74/29, 422; 413/2, 4, 6, 27, 30, 45, 52

[56] References Cited

U.S. PATENT DOCUMENTS

| | | | |
|---|---|---|---|
| 1,929,339 | 10/1933 | Troyer et al. . | |
| 2,727,481 | 12/1955 | Laxo | 413/45 X |
| 3,589,205 | 6/1971 | Radovic | 74/422 |
| 4,184,715 | 1/1980 | Lanfermann | 74/422 X |
| 5,014,491 | 5/1991 | Tsukada et al. | 413/52 X |

FOREIGN PATENT DOCUMENTS

| | | |
|---|---|---|
| 2300431 | 7/1973 | Fed. Rep. of Germany . |
| 64-18538 | 1/1989 | Japan . |
| 63141482 | 1/1990 | Japan . |
| 632704 | 12/1949 | United Kingdom . |

*Primary Examiner*—John Sipos
*Assistant Examiner*—Linda B. Johnson

[57] ABSTRACT

A can end is seamed to a cylindrical can filled with contents. The can is fed along a substantially elliptical path including straight and arcuate paths. While the can is being fed along the straight path, the can end is seamed to the can by a linear seaming device. At the same time, the can end is rotated by a can end holder which has a pinion gear held in mesh with a rack which extends fully along the elliptical path. The rack is composed of separate rack members which are relatively movable to adjust the tension of an endless chain that moves can ends and cans along the elliptical path.

13 Claims, 19 Drawing Sheets

APPARATUS FOR SEAMING CAN END

BACKGROUND OF THE INVENTION

The present invention relates to an apparatus for seaming can ends to cylindrical cans which have been filled with contents.

One known can end seaming machine is disclosed in U.S. Pat. No. 1,929,339. A can after it has been filled with contents is delivered by a belt conveyor, then engaged by a disc-shaped feed turret, and a can end is placed on the can while the can is being turned and guided by the feed turret. Thereafter, the can is turned by a seaming turret while at the same time the can end and the can are seamed together under pressure by a seaming mechanism such as an arcuate seaming rail extending along the outer periphery of the clincher turret.

In the known can end seaming machine, when the turrets are rotated, the directions in which the cans are fed by these turrets vary at all times as they are guided along the arcuate paths. Therefore, the contents of the cans which are fed in the varying directions tend to be thrown out of the cans under centrifugal forces. When the cans are fed at higher speeds, it becomes more difficult to prevent the contents from being split from the cans. It has been possible to seam can ends to cans at a rate of 200 to 250 cans per minute, at most, while preventing the contents from being split from the cans.

The applicant has proposed a can end seaming apparatus which can seam can ends to cans at high speed while preventing filled contents from being split from of the cans (see Japanese Patent Application No. 63-141482).

The proposed can end seaming apparatus operates to seam can ends to cans while the cans, filled with contents. are being fed along a straight path.

As shown in FIG. 22 of the accompanying drawings, the proposed can end seaming apparatus has a first can feed means 100 for feeding cans X along a straight path, and a second can feed means 101 to which the cans X are transferred from the first can feed means 100, the second can feed means 101 being endless and movable along a substantially elliptical path, with one run extending parallel to the first can feed means 100.

As shown in FIG. 23, the second can feed means 101 has support tables 102 on which the cans X are rotatably supported. Can end holder means 103 for holding can ends Y are disposed upwardly of the support tables 102 in confronting relation thereto. The can end holder means 103 are associated with can end feed means 104 which feed the can ends Y that are held by the can end holder means 103. The can end feed means 104 and the support tables 102 are integrally joined to an endless chain 105, which is driven to feed the cans X and the can ends Y at the same time.

As illustrated in FIGS. 22 and 23, cans X which are transferred from the first can feed means 100 to the second can feed means 101 are fed by the second can feed means 101. While the cans X are being fed by the second can feed means 101, can ends Y which are supplied from a can end feeder C to the can end holder means 103 of the can end feed means 104 are lowered into covering relation to the openings of the cans X when the can end holder means 103 are moved downwardly by a lifting/lowering means (not shown).

As shown in FIG. 23, the can X and the can end Y which are sandwiched between the can end holder means 103 and the second can feed means 101 are rotated in unison by a rotative drive means so that the can X and the can end Y roll along a straight seaming means 106. The rotative drive means includes a pinion gear 107 on the outer periphery of each of the can end holder means 103, and a rack 108 meshing with the pinion gear 107 and extending in the can feeding direction along a seaming rail 109 which serves as a seaming means 106. When the second can feed means 101, which holds the can X covered with the can end Y, moves along the straight path, the can X is fed along the straight path while the can X is being rotated through the can end holder means 103 by the meshing engagement between the pinion gear 107 and the rack 108. During this time, the portions of the can X and the can end Y, which are to be seamed, are pressed by the seaming rail 109, so that the can end Y is seamed to the can X.

With the can end seaming apparatus thus constructed, the can end is seamed to the can while they are fed along the straight path at a constant speed. Since the direction in which the can X is fed remains unchanged, the contents of the can X are prevented from being split even if the can end Y is seamed at a higher seaming speed. Therefore, the canned products can be manufactured at a higher production rate.

However, various problems will arise if the seaming speed is increased for higher production efficiency.

The first problem is caused when the speed at which the cans are fed is increased for a higher can end seeming speed.

If the cans X are fed at an increased speed, when the second can feed means 101 which circulates along the endless elliptical path and the can end feed means 102 move arcuately and then enter the straight path along the seaming means 106, the pinion gear 107 and the rack 108 suddenly start meshing with each other. At this time, the teeth of the pinion gear 107 and the teeth of the rack 108 tend to be damaged. The faster the cans X are fed, the greater the damage to the teeth of the pinion gear 107 and the rack 108. When the teeth of the pinion gear 107 and the rack 108 are damaged, the can ends Y and the cans X cannot be rotated smoothly when they are to be seamed together, and hence the can ends Y and the cans X cannot reliably be seamed together.

In order to increase the speed at which the cans X are fed, it is necessary to separate the can end holder means 103 quickly from the can ends Y after the can ends Y have been seamed to the cans X.

Japanese Laid-Open Patent Publication No. 64-18538 shows a knockout pad disposed in a seaming chuck and movable vertically to separate the seaming chuck from a can end which has been seamed to a can. However, the disclosed arrangement is complex in structure, and cannot easily speed up the vertical movement of the knockout pad. If the vertical movement of the knockout pad is speeded up, then various parts of the can end seaming apparatus are worn soon, and hence the can end seaming apparatus becomes poor in durability.

The second problem is caused when the time required to seam a can end to a can is shortened for higher productivity. The shortened seaming time may be achieved by increasing the time required to feed the can and the can end, and also by reducing the time in which the portions of the can and the can end which are to be seamed together are being pressed against the seaming rail 109.

The portions of the can and the can end which are progressively held in rolling and pressed engagement with the straight seaming rail 109 are seamed to spirally different degrees along their outer peripheries. More specifically, these portions of the can and the can end are seamed to different degrees at starting and terminal ends of the seamed portions. The difference between the different seaming degrees is larger as the seaming rail 109 is shorter. The greater the diameter of the can end Y, the larger the difference between the different seaming degrees. The contents of the can may leak from the region where the can and the can end are seamed to a smaller degree. The region where the can and the can end are seamed to a larger degree tends to wrinkle or otherwise be distorted after they are seamed since the can and the can end are seamed rapidly in that region. It is therefore difficult to seam the can end Y to the can X highly uniformly and accurately along the entire circumference of the can end Y.

The third problem occurs when there are various cans with different heights and diameters. The production rate of the can end seaming apparatus cannot be increased unless it can easily cope with different types of cans to which corresponding can ends are to be seamed.

The second can feed means 101 of the disclosed can end seaming apparatus is of a substantially inverted C-shaped structure, as shown in FIG. 23, such that the distance between the can end holder means 103 and the tables 102 matches the height of the cans X to which the can ends Y are to be seamed. However, the second can feed means 101 cannot hold cans whose height does not match the distance between the can end holder means 103 and the support tables 102.

If cans of a different height are to be held by the second can feed means 101, then the blocks of the can end holder means 103 and the support tables 102, which were previously used to seam can ends to cans, need to be replaced with those blocks which lend themselves to the height of the cans of different height.

If cans of a different diameter are to be held by the second can feed means 101, then the can end holder means 103 have to be replaced with different can end holder means which match the diameter of those cans.

The above replacement processes are time-consuming and laborious, and hence lower the production rate of the can end seaming apparatus.

SUMMARY OF THE INVENTION

It is an object of the present invention to provide a can end seaming apparatus which can seam can ends to cans at high speed without allowing the contents of the cans to be split from the cans.

Another object of the present invention is to provide a can end seaming apparatus which is durable enough to withstand high-speed seaming of can ends to cans.

Still another object of the present invention is to provide a can end seaming apparatus which can seam can ends to cans highly accurately at high speed.

Yet another object of the present invention is to provide a can end seaming apparatus which is capable of efficiently seaming can ends to various cans of different heights.

To achieve the above objects, there is provided an apparatus for seaming a can end to a filled cylindrical can, comprising first can feed means for feeding the can linearly horizontally at a predetermined speed, second can feed means for receiving the can from the first can feed means while supporting the can rotatably, the second can feed means being movable along a substantially elliptical path composed of a straight path and an arcuate path, for feeding the can along the substantially elliptical path, can end feed means disposed above the second can feed means in confronting relation thereto and movable in synchronism with the second can feed means, can end holder means for detachably holding the can end, the can end holder means being rotatably and vertically movably disposed in the can end feed means, lifting/lowering means for lowering the can end holder means to place the can end held by the can end holder means against an open end of the can, rotative drive means for rotating the can end holder means to rotate the can end and the can in unison with each other, and linear seaming means for pressing the can end to seam the same to the can while the second can feed means is being moved along the straight path, the rotative drive means comprising a pinion gear coaxial and rotatable with the can end holder means and a rack meshing with the pinion gear and extending fully along the substantially elliptical path.

The rack extends fully along the path of the can end feed means, and the pinion gear integral with the can end holder means is held in mesh with the rack at all times. Therefore, when the can end feed means moves, the can end holder means is rotated. Accordingly, the can end can be seamed to the can at high speed.

The apparatus further comprises a drive sprocket, a driven sprocket, and an endless chain trained around the drive and driven sprockets, the second can feed means and the can end feed means being movable by the endless chain, the rack extending along the substantially elliptical path, the rack comprising two separate first rack members disposed in the straight path remotely from the linear seaming means and having teeth, and two second rack members disposed in gaps defined between the first rack members, the second rack members having teeth contiguous to the teeth of the first rack members, the second rack members being angularly movable about downstream ends thereof with respect to a direction in which the can end holder means is movable.

The driven sprocket can be moved away from the drive sprocket to tension the endless chain, thus preventing the endless chain from sagging. The first rack member disposed around the driven sprocket can also be moved by the same distance as that by which the driven sprocket can be moved away from the driven sprocket. The second rack members are disposed in the gaps between the first rack members and interconnect the first rack members. The pinion gear can be moved from one of the first rack members through one of the second rack members onto the other first rack member. The pinion gear is thus held in smooth mesh with the rack members.

If the teeth of the pinion gear and the teeth of the second rack member do not smoothly mesh with each other at a position where the pinion gear should start to mesh with the second rack member, then the second rack member is forcibly turned about its downstream end by the pinion gear. When the pinion gear and the second rack member are brought into mesh with each other, the second rack member is resiliently returned to the position where it interconnects the first rack members, and guides the pinion gear toward the first rack member.

Although the rack, which is disposed in mesh with the pinion gear of the can end holder means for speeding up the seaming of the can end, extends fully around the path of the can end holder means, the rack does not obstruct the adjustment of the tension of the endless chain which actuates the can end holder means and the second can feed means.

The apparatus further comprises a drive sprocket, a driven sprocket, and an endless chain trained around the drive and driven sprockets, the second can feed means and the can end feed means being movable by the endless chain, the rack extending along the substantially elliptical path, the rack comprising two separate first rack members disposed in the straight path remotely from the linear seaming means and having teeth, and two second rack members disposed in gaps defined between the first rack members, the second rack members having teeth contiguous to the teeth of the first rack members, the second rack members being slidable downstream with respect to a direction in which the can end holder means is movable.

When the pinion gear of the can end holder means moves along each of the second rack members, the second rack member meshes the pinion gear. At this time, the second rack member is moved downstream in the gap between the first rack members by the pinion gear with which the second rack member meshes. When the second rack member abuts against the downstream first rack member, the pinion gear starts rotating on the second rack member and moves onto the downstream first rack member. Then, the second rack member returns into a position in which it engages the upstream first rack member, so that the second rack member is readied for mesh with the next pinion gear. Therefore, the second rack member is movable in the gap with the pinion gear, allowing the pinion gear to mesh smoothly with the downstream first rack member.

Consequently, the rack, which is disposed in mesh with the pinion gear of the can end holder means for speeding up the seaming of the can end, and extends fully around the path of the can end holder means, does not obstruct the adjustment of the tension of the endless chain which actuates the can end holder means and the second can feed means.

The can end feed means includes a support shaft, the can end holder means being rotatably and detachably supported on the support shaft by a bearing.

When the can end holder means starts to be rotated by the rack through the pinion gear, the moment of inertia tending to keep the can end holder means at rest is reduced, and any load on the teeth of the rack and the pinion gear is also reduced. Even if the can end quickly starts being seamed for a high-speed can end seaming process, the pinion gear and the rack are prevented from being damaged or otherwise impaired. When can ends of a different diameter are to be seamed, it is only necessary to replace the can end holder means with a can end holder means which matches the new can end diameter. Therefore, the procedure to adjust the seaming apparatus to such different-diameter can ends is simplified.

Furthermore, the seaming means includes an inclined seaming segment for seaming the can end to a progressively greater degree, the inclined seaming segment having such a length to allow the can end to make at least one revolution in a direction in which the can end is fed, and a straight seaming segment for seaming the can end to a constant degree, the straight seaming segment being joined to the inclined seaming segment and having such a length to allow the can end to make at least one revolution.

The can end and the can are pressed and seamed together along the inclined seaming segment while making one revolution on the inclined seaming segment. Then, the can end and the can are pressed and seamed together along the straight seaming segment while making one revolution on the straight seaming segment. The inclined seaming segment has an inclined edge which is progressively displaced toward the can end, so that the can end is seamed to a progressively greater degree by the inclined seaming segment. The portion of the can end which is pressed by the inclined seaming segment is spirally seamed to different degrees at seaming starting and ending positions. However, when the can end is subsequently pressed by the straight seaming segment, the portion of the can end which has been seamed by the inclined seaming segment is seamed to a constant degree. As a result, the can end is seamed uniformly along its entire outer circumferential edge. With this arrangement, the can end and the can can be seamed together with high accuracy even when they are seamed at high speed.

Alternatively, the linear seaming means comprises a first straight seaming segment for seaming the can end to a constant degree, the first straight seaming segment having such a length to allow the can end to make at least one revolution in a direction in which the can end is fed, and a second straight seaming segment for seaming the can end to a constant degree greater than the constant degree by the first straight seaming segment, the second straight seaming segment having such a length as to allow the can end to make at least one revolution, and an inclined seaming segment for seaming the can end to a progressively greater degree, the inclined seaming segment being disposed between and interconnecting the first and second straight seaming segments and having such a length to allow the can end to make at least one revolution.

The can end is pressed and seamed to a constant degree by the first straight seaming segment while making one revolution thereon, and then pressed and seamed by the inclined seaming segment while also making one revolution thereon. When the can end is seamed by the inclined seaming segment, the degree to which it is seamed is greater than the degree to which it has been seamed by the first straight seaming segment, and hence the diameter of the can end is reduced. At a seaming starting position on the inclined seaming segment, the can end is seamed to a larger degree and its diameter is larger, and at a seaming ending position on the inclined seaming segment, the can end is seamed to a smaller degree and its diameter is smaller. Since the can end has already been seamed by the first straight segment, the difference between the different seaming degrees is relatively small, and hence any sudden seaming of the can end on the inclined seaming segment is reduced. Thereafter, the can end is pressed and seamed by the second straight seaming segment to a constant degree larger than the degree by which it was seamed by the first straight seaming segment, while making one revolution on the second straight seaming segment, so that any difference created between the different seaming degrees by the inclined seaming segment will be eliminated by the second straight seaming segment. Therefore, the can end is seamed uniformly fully along its outer circumferential edge. The inclined seaming segment allows the can end to be transferred smoothly from the first seaming segment to the second seaming segment. Thus, the can end is seamed to a progressively greater degree by the different seaming segments, and is seamed uniformly fully along its outer circumferential edge. With the above arrangement, the can end and the can can be seamed together highly accurately at high speed.

Furthermore, the linear seaming means comprises a first straight seaming segment for seaming the can end to a constant degree, the first straight seaming segment having such a length to allow the can end to make at least one revolution in a direction in which the can end is fed, and a second straight seaming segment for seaming the can end to a constant degree greater than the constant degree by the first straight seaming segment, the second straight seaming segment having such a length as to allow the can end to make at least one revolution, and an inclined seaming segment for guiding the can end, the inclined seaming segment being disposed between and interconnecting the first and second straight seaming segments.

First, the can end is pressed and seamed to a constant degree by the first straight seaming segment while making one revolution thereon, and then moved through the inclined seaming segment onto the second straight seaming segment by which the can end is pressed and seamed to a constant degree larger than the degree by which it was seamed by the first straight seaming segment. Therefore, the can end is seamed to different degrees by the first and second straight seaming segments while making one resolutions on each of the first and second straight seaming segments. Since the can end is separately seamed by the first and second straight seaming segments, the can end can be seamed to a progressively greater degree by these seaming segments, and can be seamed uniformly fully along its outer circumferential edge. Since each of the separate straight seaming segments seams the can end to a relatively small degree, the can end is not seamed suddenly by each straight seaming segment but can be seamed uniformly. Consequently, the can end can be seamed highly accurately at high speed.

The linear seaming means includes an engaging portion, disposed downstream of a position where the can seam is completely seamed by the linear seaming means, for engaging an upper edge of the can end. The can end holder means is elevated out of engagement with the can end when the can end has moved past the engaging portion.

The can end is held by the can end holder means and rolls along the linear seaming means. The can end is pressed against and seamed by the linear seaming means. After having been seamed, the seamed can end is released from the linear seaming means and rolls along the engaging portion, which engages the upper edge of the can end from the position where the can end is completely seamed. Then, the can end holder means is elevated. Inasmuch as the can end with its upper edge engaged by the engaging portion is prevented from ascending with the can end holder means, only the can end holder means is elevated. Therefore, after the can end has been fully seamed, the can end holder means can easily be released from the can end. This arrangement can catch up with a high-speed process of seaming the can end.

The seaming apparatus further includes a support on which the second can feed means is mounted, an elongate member fixed to the support and extending along the height of the can, the can end feed means being vertically movably supported on the elongate member, a guide member mounted on the can end feed means, a guide rail for causing the guide member to vertically move the can end feed means between a position in which the can end is placed against the open end of the can and a position in which the can end holder means is released from the can end, the guide rail being vertically movable and extending along the direction in which the can end is fed by the can end feed means, and adjusting means for vertically moving the guide rail to adjust the vertical position thereof.

When a can of a different height is to be processed, the guide rail is vertically moved until it matches the height of the can, and the can end feed means is guided by the guide rail through the guide member at a position which matches the height of the can. The can end feed means is vertically moved along the elongate member to equalize the distance between the can end holder means and the can holder means to the height of the can. With this arrangement, the apparatus can easily process cans of different heights and is hence versatile.

Alternatively, the seaming apparatus further includes a support on which the second can feed means is mounted, an elongate member fixed to the support and extending along the height of the can, the can end feed means being vertically movably supported on the elongate member, a support shaft vertically slidably mounted on the can end feed means, the can end holder means being rotatably mounted on a lower end of the support shaft, a first guide member mounted on the can end feed means, a first guide rail for causing the first guide member to hold the can end feed means in a predetermined vertical position and guide the can end feed means, the first guide rail being vertically movable and extending along the direction in which the can end is fed by the can end feed means, a second guide member mounted on the support shaft, a second guide rail for causing the second guide member to vertically move the can end holder means between a position in which the can end is placed against the open end of the can and a position in which the can end holder means is released from the can end, the second guide rail being vertically movable and extending along the direction in which the can end is fed by the can end feed means, and adjusting means for vertically moving the first and second guide rails to adjust the vertical position thereof.

The first guide rail is brought into a position which matches the height of the can, and the first guide member is guided by the first guide rail to guide the can end feed means at said position. The second guide rail guides the second guide member downwardly to lower the can end holder means in the position where the can end is placed over the can. In the position where the can end holder means is released from the can end, the second guide member is guided upwardly to cause the support shaft to ascend. Simply by positioning the first guide rail, which extends along the direction in which the can end is fed by the can end feed means, in the position which matches the height of the can, the can end feed means can be vertically moved along the elongate member to the position matching the height of the can. The support shaft is vertically moved by the second guide rail to permit the can end holder means to ascend and descend in the given position. Therefore, can ends can easily be seamed to cans of different heights by the seaming apparatus.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
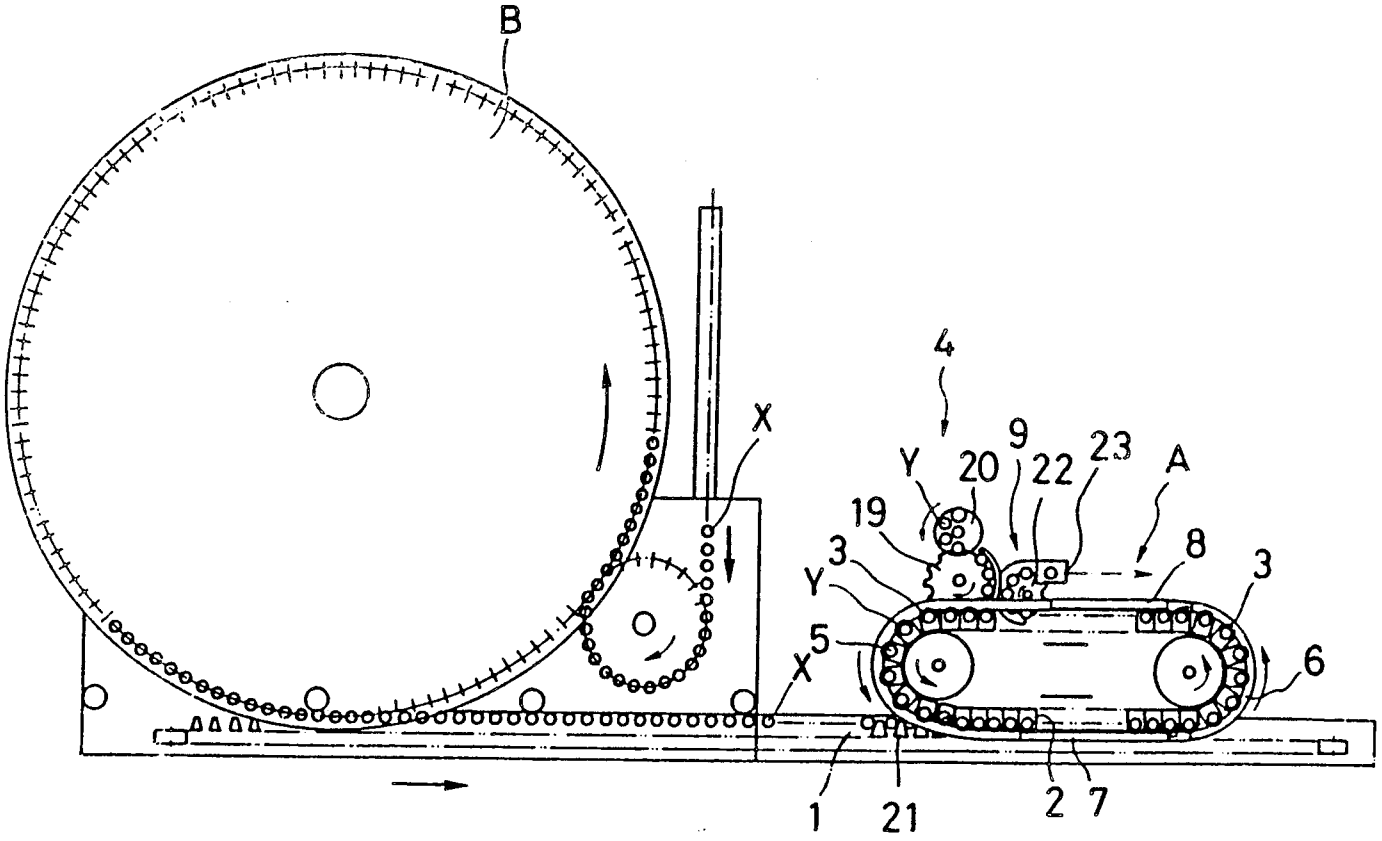
FIG. 1 is a schematic plan view of a can manufacturing system including a seaming apparatus according to an embodiment of the present invention.

FIG. 1 schematically shows a can manufacturing system including a seaming apparatus A according to an embodiment of the present invention for double-seaming can ends or covers Y to cans X which are successively supplied from a filling apparatus B by which the cans X are filled with contents.

The seaming apparatus A includes a first can feed means 1 for linearly feeding filled cans X from the filling apparatus B horizontally at a predetermined speed, a second endless can feed means 2 rotatable along a substantially elliptical path for feeding cans X, a can end feed means 3 in the second can feed means 2 for feeding can ends or covers Y, a can end supply means 4 for successively supplying can ends Y to the can end feed means 3, a can end holder means 5 for holding can ends Y on the can end feed means 3, a rotative drive means 6 for rotating the can end holder means 5 to rotate can ends, a first seaming means 7 disposed parallel to a forward feed path of the second can feed means 2 for feeding cans X linearly, a second seaming means 8 disposed parallel to a return feed path of the second feed means 2 for feeding cans X linearly, and a discharge means 9 for discharging cans X to which can ends Y have been seamed.

Figure 2:
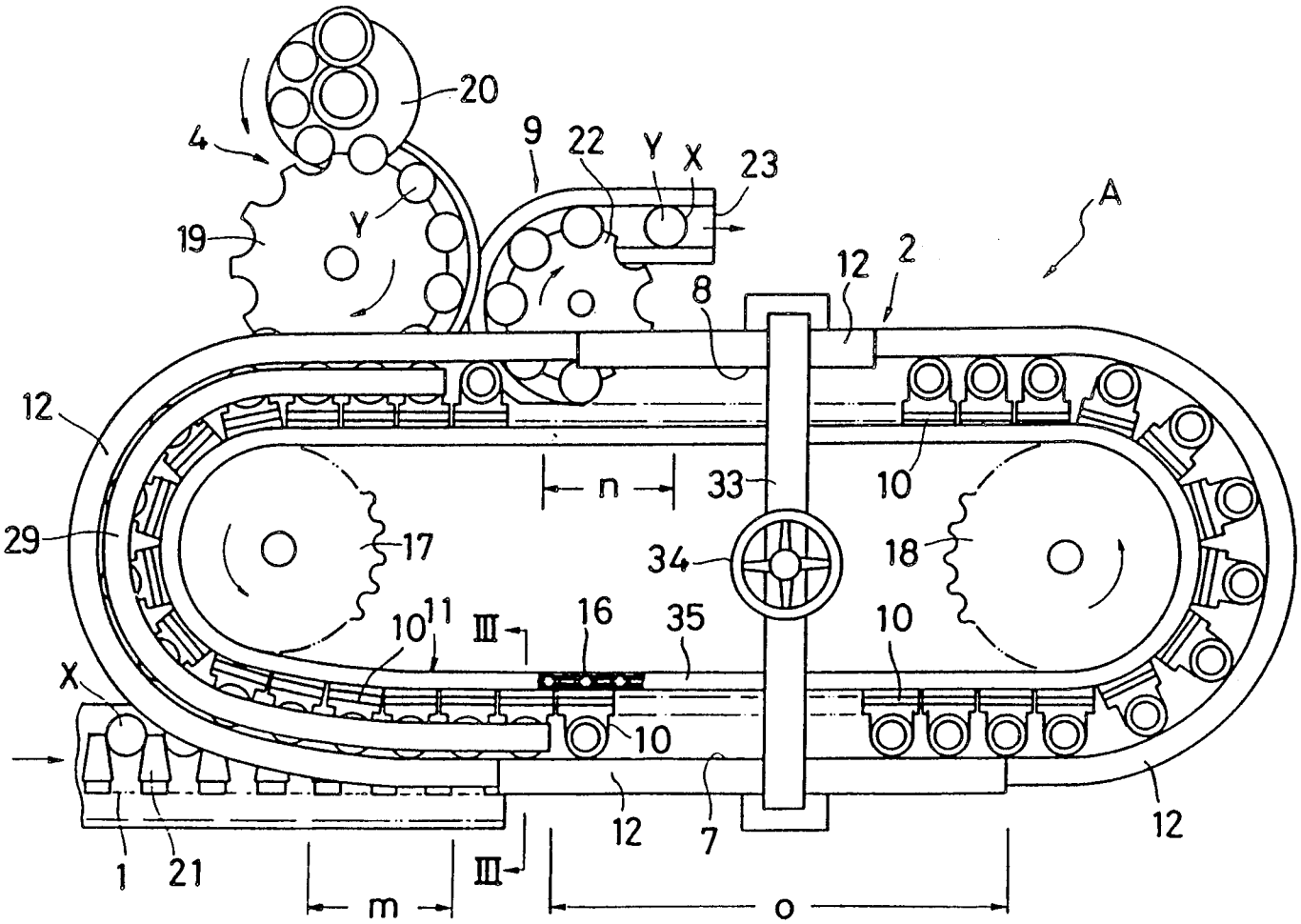
FIG. 2 is an enlarged fragmentary plan view of the seaming apparatus shown in FIG. 1.

As shown in FIG. 2, the second can feed means 2 comprises a can holder means 10 for holding cans X with can ends Y fitted thereover, and a rotating means 11 for rotating the can holder means 10 along a substantially elliptical, endless path. The second can feed means 2 also includes a guide rail 12 for controlling the vertical position of the can end free means 3 substantially fully along the endless path along which the can holder means 10 are movable.

Figure 3:
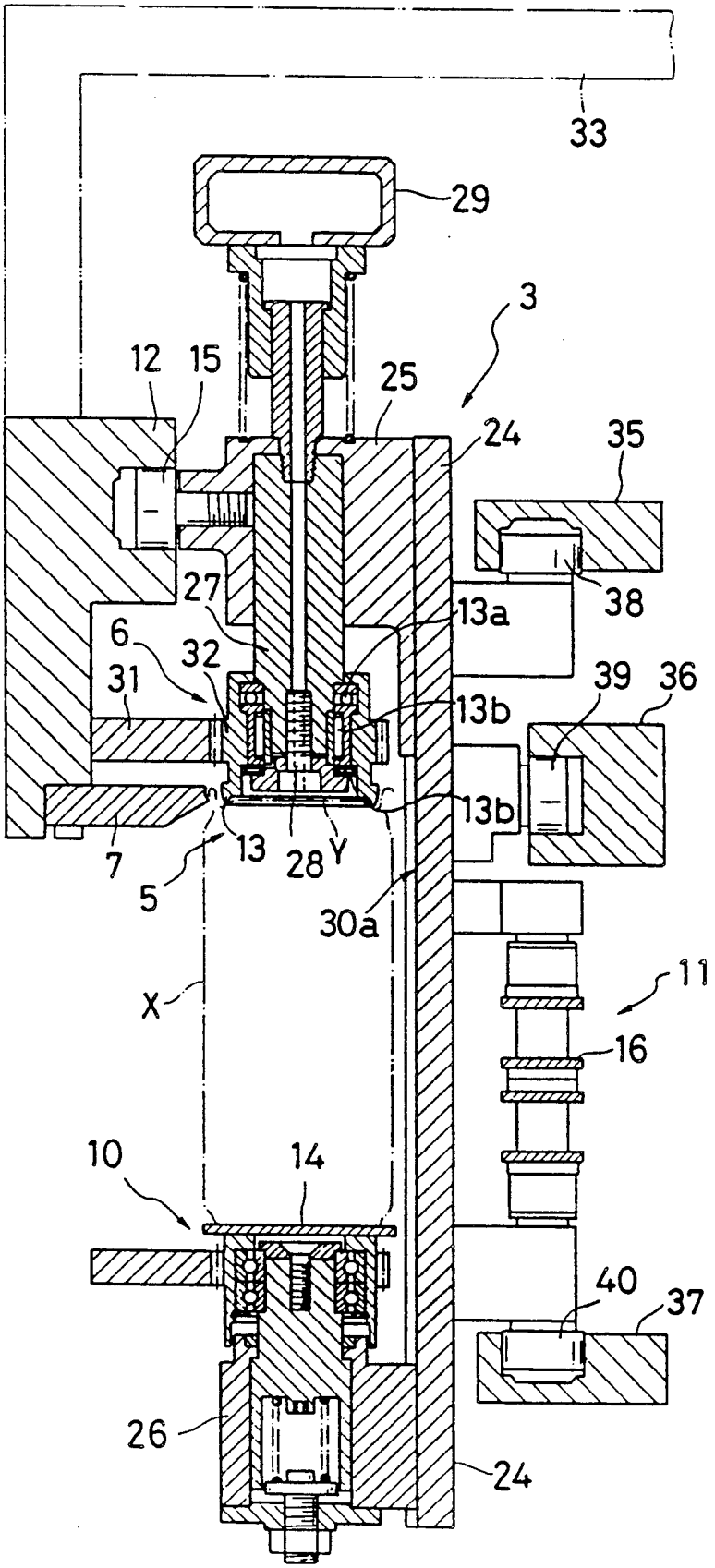
FIG. 3 is a cross-sectional view taken along line III—III of FIG. 2.

As shown in FIG. 3, the can holder means 10 has a rotatable support table 14 for placing a can X thereon. The support table 14 is supported on a support shaft **14*a* which is rotatably mounted on a support 26. The can end holder means 5 comprises a rotatable seaming chuck 13 positioned above the support table 14. As described later on, a can end Y can detachably be held by the seaming chuck 13, and the seaming chuck 13 is vertically movable with the can end feed means 3 while being guided by a guide roller 15**.

The guide rail 12 and the guide roller 15 serve as a lifting/lowering means for lifting and lowering the can end holder means 5.

As shown in FIG. 2, the rotating means 11 comprises an endless chain 16 coupled to the can holder means 10 and movable along the endless path, and an actuator (not shown) for driving the endless chain 16 through a drive sprocket 17 and a driven sprocket 18 around which the endless chain 16 is trained.

The can end supply means 4 comprises a can end supply turret 19 rotatable about its own axis and a can end supply device 20 for delivering can ends to the can end supply turret 19. The can end supply turret 19 rotates in timed relation to movement of the can end holder means 3 and transfers a can end Y to the seaming chuck 13 of the can end holder means 5 at a position where the can end holder means 5 lies tangentially to the can end supply turret 19.

The first can feed means 1 comprises a linear array of attachments 21 for holding cans X, and an actuator (not shown) for linearly moving the attachments 21. The first can feed means 1 operates in synchronism with movement of the can holder means 10 to transfer cans X onto the support tables 14 thereof at a transfer position where the first can feed means 1 is joined to the second can feed means 2. The attachments 21 are vertically swingable such that the attachments 21 are vertically moved to release the cans X the instant they transfer the cans X onto the support tables 14.

As illustrated in FIG. 3, the guide rail 12 has a laterally open recess in which the guide roller 15 is rollingly movable along the path of the can end feed means 3.

When the guide roller 15 is guided along the guide rail 12, the seaming chuck 13 is vertically moved.

The first and second seaming means 7, 8 are disposed along straight paths along which the can holder means 10 is movable, the first and second seaming means 7, 8 extending parallel to straight portions of the guide rail 12.

As shown in FIG. 2, the discharge means 9 comprises a rotatable discharge turret 22 and a discharge chute 23 for receiving cans X from the discharge turret 22 and discharging the received cans X. The discharge turret 22 rotates in synchronism with movement of the can holder means 10 to receive cans X with can ends Y seamed thereto from the can holder means 10 at a position where the can holder means 10 lies tangentially to the discharge turret 22, and also to transfer the received cans X to the discharge chute 23.

Figure 4:
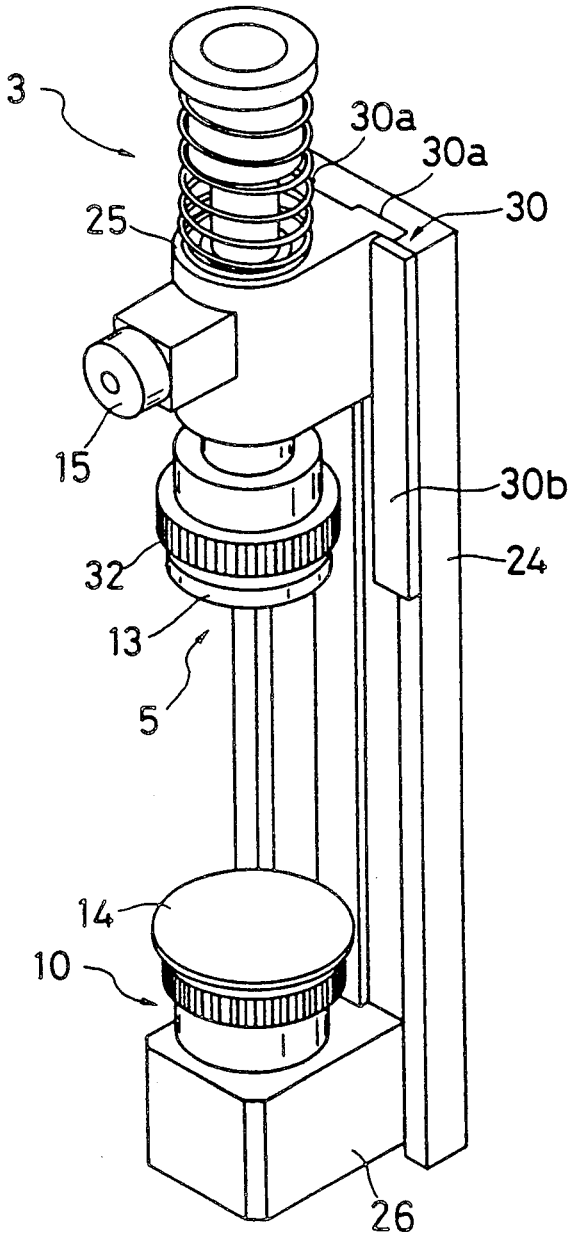
FIG. 4 is a perspective view of a can feed means and a can end feed means.

As shown in FIGS. 3 and 4, the can holder means 10 includes an elongate member 24 extending vertically or along the height of the can X. The support 26 with the support table 14 rotatably supported thereon is attached to a lower portion of the elongate member 24. The can end holder means 5 includes a vertically movable block 25 mounted on an upper portion of the elongate member 24. The support 26, the elongate member 24, and the block 25 are joined in the shape of an inverted C as shown in FIG. 3. A support shaft 27 is vertically movably mounted in the block 25. The seaming chuck 13 which holds a can end Y in confronting relation to the support table 14 is rotatably supported on the lower end of the support shaft 27 by a ball bearing 13*a* and a needle bearing 13*b*. The support shaft 27 has a vertical axial through hole 28 defined therein and extending from its upper end to the seaming chuck 13. As shown in FIGS. 2 and 3, a suction duct 29 connected to a vacuum suction device (not shown) is positioned above the path of the support shaft 27. The suction duct 29 extends from a position where can ends Y are supplied from the can end supply means 4 to a position where can ends Y are fitted over cans X. The upper end of the hole 28 in the support shaft 27 is held in communication with the suction duct 29 while the can end holder means 3 is moving. The can end Y which is held by the can end holder means 3 is attracted under suction to the seaming chuck 13 through the hole 28 that communicates with the vacuum suction device.

Figure 5:
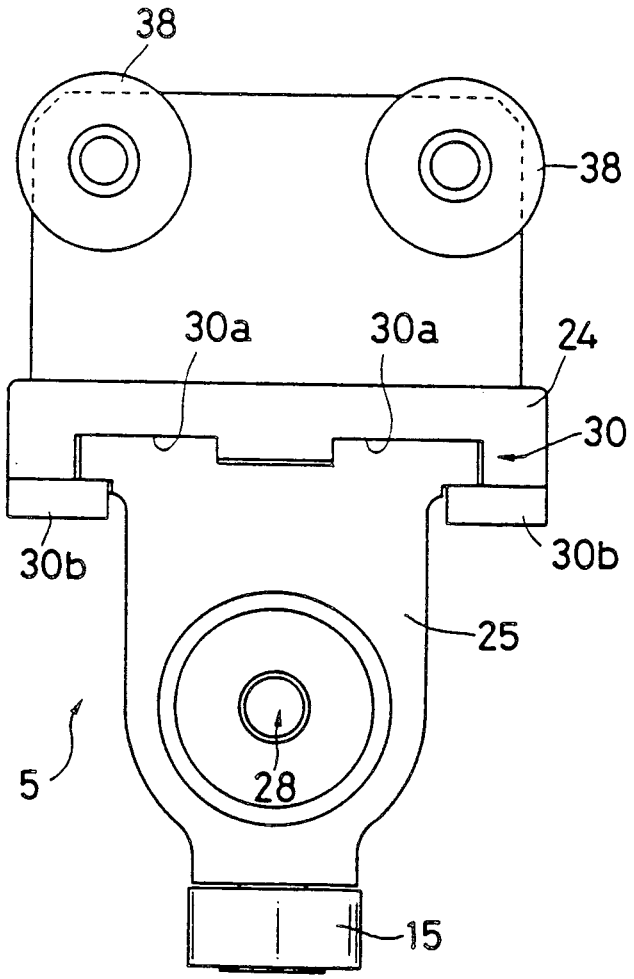
FIG. 5 is a plan view of the can end feed means shown in FIG. 4.

As shown in FIGS. 4 and 5, the block 25 is slidably mounted on a holder rail 30 extending vertically along the elongate member 24. The holder rail 30 comprises, as shown in FIG. 5, a pair of parallel grooves 30*a* defined in the elongate member 24 and in which a rear portion of the block 25 is slidably received, and a pair of parallel holders 30*b* attached to the elongate member 24 and holding the opposite ends of the rear portion of the block 25. The block 25 is therefore vertically movable along the elongate member 24 while being held by the holder rail 30. Since the block 25 is thus slidable along the holder rail 30, the seaming chuck 13 on the block 25 is also movable with the block 25 to a vertical position which matches the height of the can X which is placed on the support table 14. The parallel grooves 30*a* are effective in preventing the block 25 as it is moved vertically from horizontally vibrating or wobbling in a direction normal to the direction in which the block 25 vertically moves. Therefore, the block 25 is movable vertically in a highly accurate manner.

Figure 6:
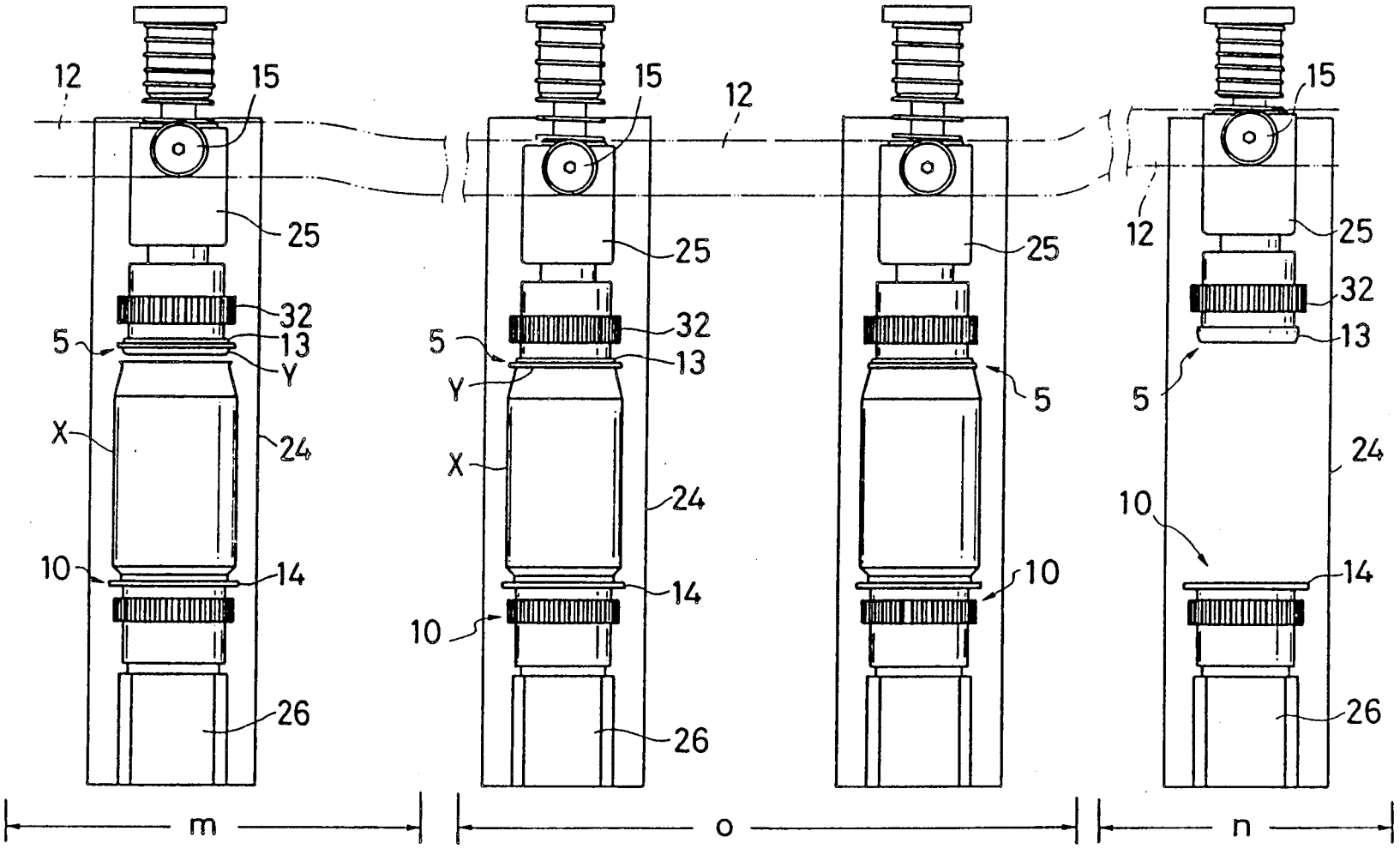
FIG. 6 is an elevational view showing the manner in which the can feed means and the can end feed means operate.

One guide roller 15 is rotatably mounted on each block 25. As shown in FIG. 3, the guide roller 15 is guided by the guide rail 12 which extends along the direction in which the can end feed means 3 moves. The guide rail 12 guides the seaming chuck 13 to a vertical position which matches the height of cans X to which can ends Y are to be seamed. As shown in FIGS. 2 and 6, the guide rail 12 guides the guide roller 15 downwardly to lower the seaming chuck 13 with the can end Y held thereon, in a region m where the can X is received from the first can feed means 1 and the can end Y is placed on the can X. The guide rail 12 guides the guide roller 15 upwardly to lift the seaming chuck 13 away from the can end Y, in a region n where the can X with the can end Y seamed thereto is transferred to the discharge means 9. In this manner, the distance between the seaming chuck 13 and the support table 14 is adjusted to the height of the can X which is held by the can holder means 10.

The first seaming means 7 is disposed in a region o on the straight path along which the can holder means 10 is movable. The first seaming means 7 is integrally connected to the guide rail 12 and horizontally aligned with each seaming chuck 13. The rotative drive means 6 comprises a rack 31 extending parallel to and integrally associated with the first seaming means 7, and a pinion gear 32 integral with the seaming chuck 13 and held in mesh with the rack 31. The seaming chuck 13 can be forcibly rotated by the pinion gear 32 meshing with the rack 31.

The guide rail 12 with which the first seaming means 7 and the rack 31 are integrally associated can be moved vertically in response to rotation of a handle 34 of a vertical adjusting means 33 (FIG. 2) which adjusts the vertical position of the guide rail 12.

As shown in FIG. 2, the can holder means 10 and the can end holder means 5 are provided in plural pairs spaced at equal intervals and coupled to the rotating means 11. The can holder means 10 and the can end holder means 5 in each pair are fixed at their rear portion to the endless chain 16 which is movable in the elliptical endless path by the actuator. The can holder means 10 and the can end holder means 5 are therefore movable along the elliptical endless path when the endless chain 16 is moved. As shown in FIG. 3, the elongate member 24 supports on its rear surface guide rollers 38, 39, 40 which are guided by respective guide rails 35, 36, 37 extending parallel to the endless chain 16.

Figure 7:
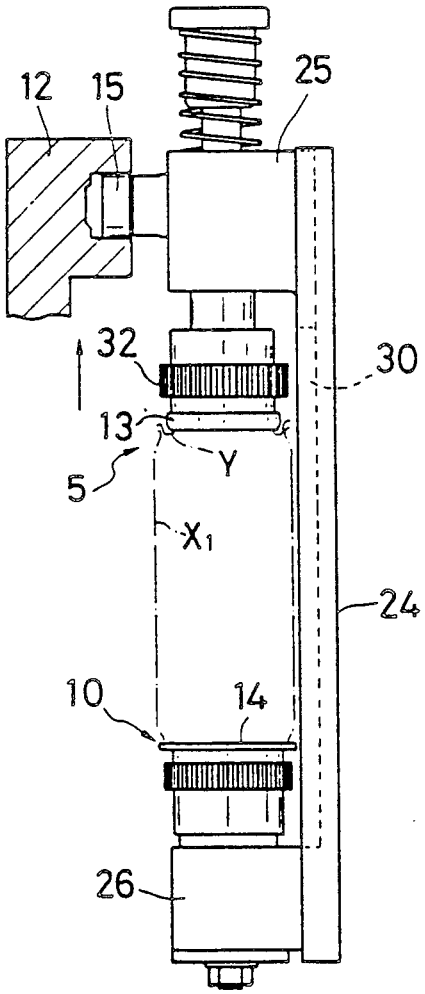
FIGS. 7 and 8 are elevational views showing how cans are held by the can feed means and the can end feed means.
Figure 8:
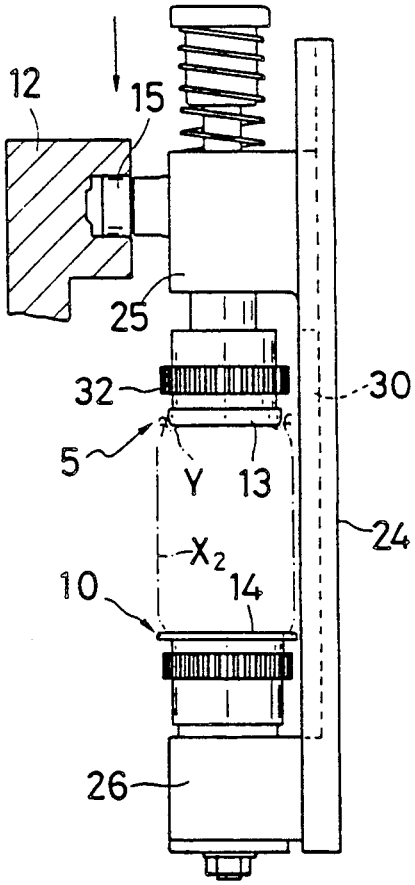

When a can $X_1$ of a greater height is to be held, as shown in FIG. 7, the guide rail 12 is vertically moved into a position which matches the height of the can $X_1$. The can $X_1$ can then be held in position by the can holder means 10 simply by guiding the guide roller 15 along the vertically adjusted guide rail 12. When a can $X_2$ of a smaller height is to be held, as shown in FIG. 8, the guide rail 12 is lowered into a position which matches the smaller height of the can $X_2$. The can $X_2$ can now be held in position simply by guiding the guide roller 15 along the guide rail 12. Therefore, the seaming apparatus A can easily be adjusted to the height of the can $X_2$ within a short period of time.

Figure 9:
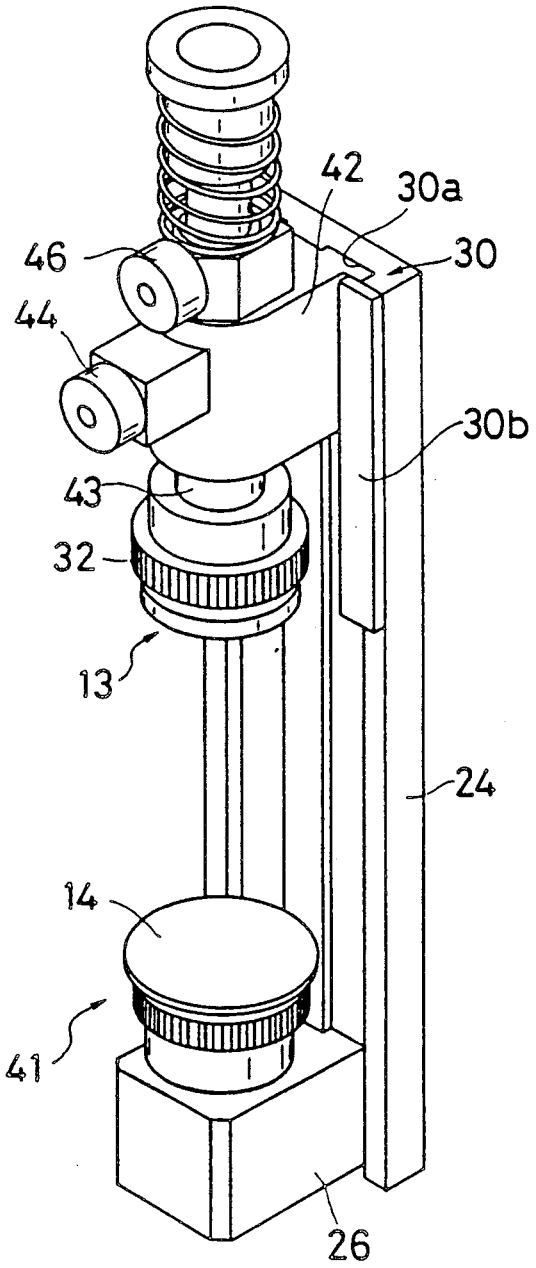
FIG. 9 is a perspective view of a can feed means and a can end feed means according to another embodiment of the present invention.
Figure 10:
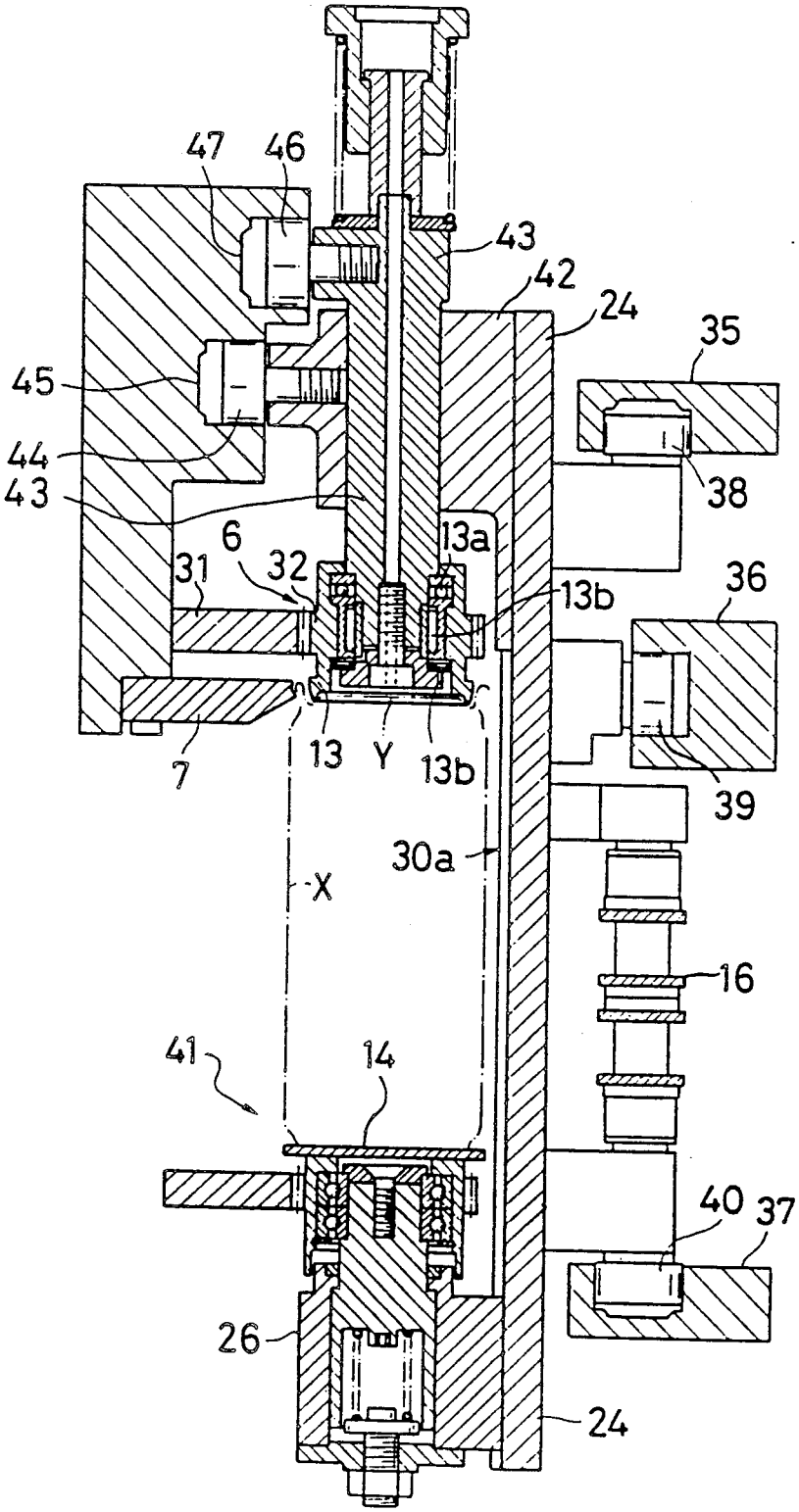
FIG. 10 is a cross-sectional view of the can feed means and the can end feed means shown in FIG. 9.
Figure 11:
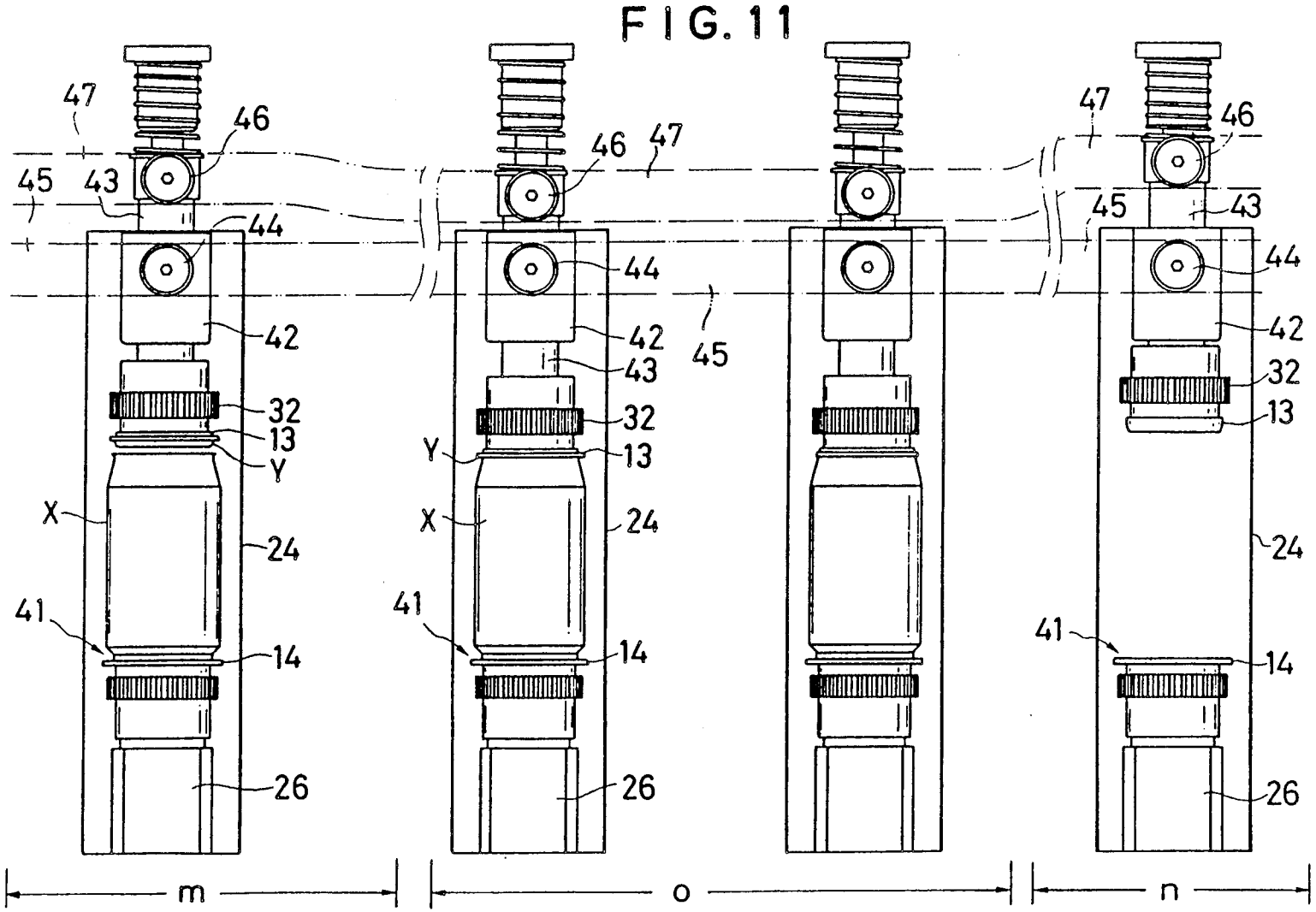
FIG. 11 is an elevational view showing the manner in which the can feed means and the can end feed means shown in FIG. 9 operate.

FIGS. 9 through 11 show a can feed means and a can end feed means according to another embodiment of the present invention. Those parts shown in FIGS. 9 through 11 which are identical to those shown in FIGS. 1 through 8 are denoted by identical reference numerals.

As shown in FIGS. 9 and 10, a can holder means 41 and a can end holder means 13 include a support 26 and a vertically movable block 42, respectively, which are supported on a vertically elongate member 24. The support 26, the block 42, and the elongate member 24 are jointly in the shape of an inverted C as viewed in elevation. A support table 14 for supporting a can X thereon is rotatably supported on the support 26.

The vertically movable block 42 supports a vertically movable support shaft 43 on which there is mounted a rotatable seaming chuck 13 for holding a can end Y in confronting relation to the support table 14. The block 42 is vertically slidably mounted on a holder rail 30 mounted on and extending vertically along the elongate member 24. The holder rail 30 is of the same construction as that of the previous embodiment.

The block 42 is slidable along the holder rail 30, and the support shaft 43 is slidably supported on the block 42. Therefore, the seaming chuck 13 on the support shaft 43 is slidable with the block 42, and hence the distance between the seaming chuck 13 and the support table 14 can be increased or reduced to a dimension which matches the height of the can X to be held by the can holder means 41.

A first guide roller 44 is rotatably mounted on one side of the block 42. The first guide roller 44 is guided along a first guide rail 45 extending fully along the path in which the can holder means 41 is movable. A second guide roller 46 is rotatably mounted on an upper end portion of the support shaft 43. The second guide roller 46 is guided along a second guide rail 47 extending parallel to the first guide rail 45.

The first guide rail 45 guides the first guide roller 44 to equalize the distance between the seaming chuck 13 and the support table 14 to the height of a can X to which a can end Y is to be seamed. The second guide rail 47 guides the second guide roller 46 downwardly to lower the seaming chuck 13 which holds a can end Y in a region m (FIG. 11) where a can X is received from the first can feed means 1 and placed over the can Y, and also guides the second guide roller 46 upwardly to lift the seaming chuck 13 away from the can end Y, in a position n where the can X is transferred to the discharge means 9.

When a can end Y is to be seamed to a can X of a different height, the first and second guide rails 45, 47 are vertically moved in unison by the handle 34 of the vertical adjusting means 33 (FIG. 2), and the block 42 is moved into the position matching the height of the can X by the guide roller 44.

The rotative drive means 6 will be described in detail below.

Figure 12:
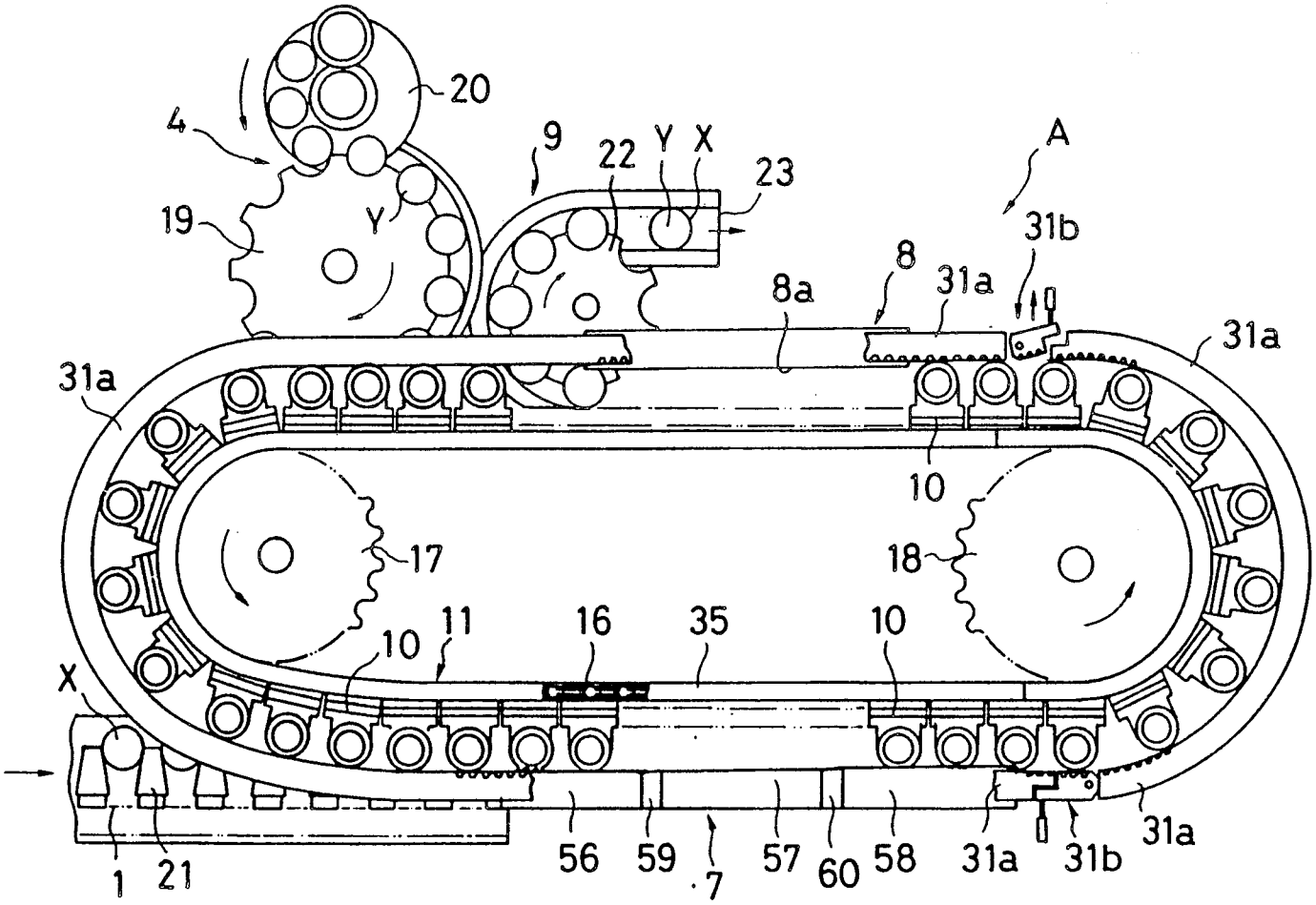
FIG. 12 is an enlarged fragmentary plan view of the seaming apparatus shown in FIG. 1.
Figure 13:
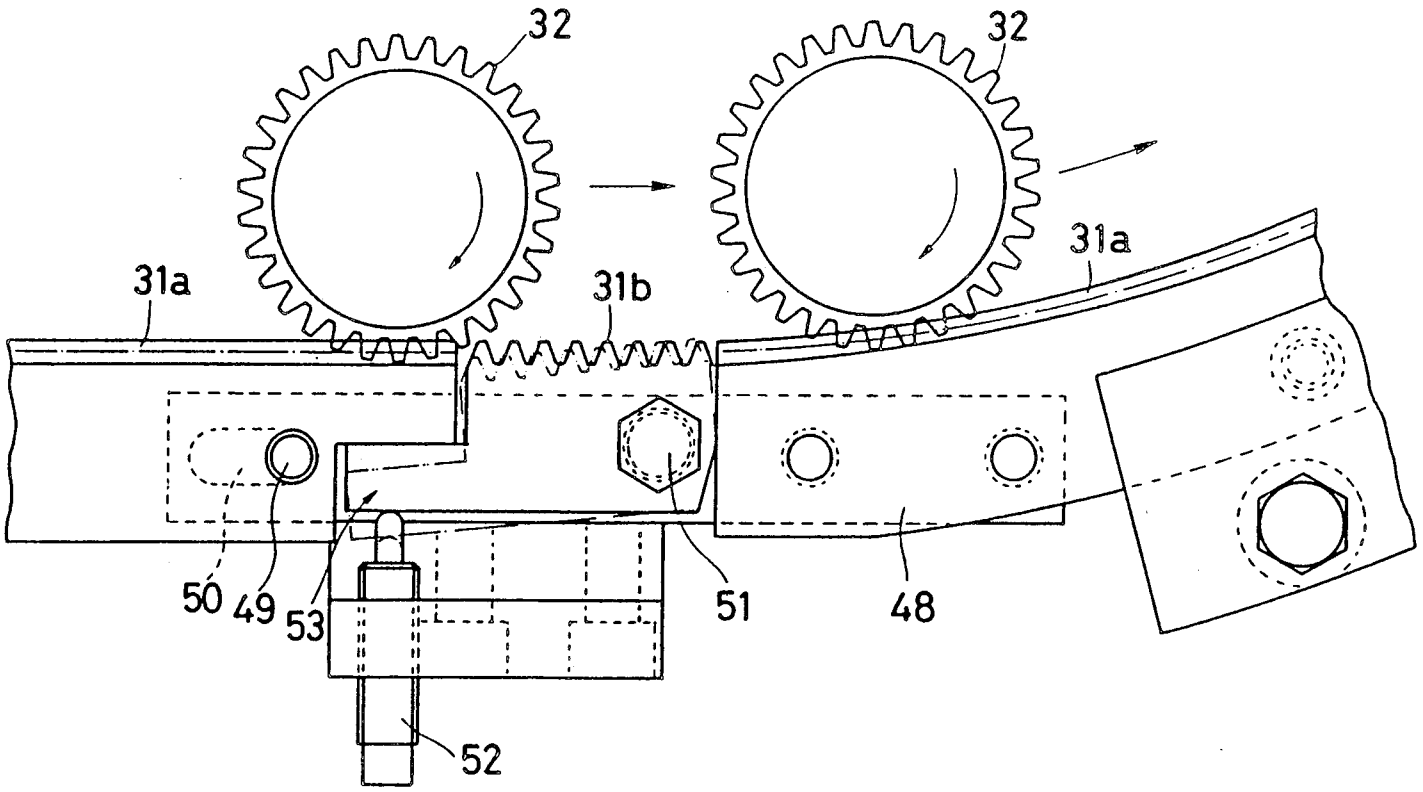
FIG. 13 is an enlarged plan view showing how a rotative drive means in the seaming apparatus illustrated in FIG. 1 operates.

As shown in FIG. 12, the rack 31 of the rotative drive means 6 comprises two first rack members 31*a* and two second rack members 31*b*. The first rack members 31*a* extend substantially fully along the path of the can end feed means 3, the first rack members 31*a* meshing with the pinions 32. The first rack members 31*a* are separate from each other by gaps in straight path regions other than the seaming means 7, 8. As shown in FIG. 13, the first rack members 31*a* are connected to each other by connectors 48 extending across the gaps and fastened by bolts 49. The first rack member 31*a* which extends around the driven sprocket 18 can be moved relative to the other first rack member 31*a* when the bolts 49 are loosened and holes 50 defined in the connectors 48 and receiving the bolts 49 are moved relative to the bolts 49. The second can feed means 2 is coupled to the endless chain 16 which is trained around the drive sprocket 17 and the driven sprocket 18. When the tension of the endless chain 16 is to be increased, the driven sprocket 18 is moved away from the drive sprocket 17. At this time, the first rack member 31*a* around the driven sprocket 18 is also moved away from the other first rack member 31*a* by the same distance. In this manner, the endless chain 16 can be suitably tensioned with ease.

As shown in FIG. 13, each of the second rack members 31*b* is disposed between the first rack members 31*a* across the gap therebetween. The second rack member 31*b* has a series of teeth contiguous to the teeth of the first rack members 31*a*, so that the second rack member 31*b* can also mesh with the pinion gears 32. The second rack member 31*b* is angularly movably supported by a hinge pin 51 at one end of the second rack member 31*b* which is positioned downstream with respect to the direction in which the can end holder means 5 are movable. The second rack member 31*b* is normally urged inwardly of the rack 31 by a spring-biased plunger 52, until the second rack member 31*b* is engaged by an engaging portion 53. Therefore, the second rack members 31*b* are usually held in smoothly continuously connected relationship with the first rack members 31*a*.

When the can holder means 10 move along the first and second seaming means 7, 8, as shown in FIGS. 12 and 13, the pinion gears 32 rotate in mesh with the upstream first rack member 31*a* to rotate the seaming chucks 13 and the support tables 14. The rotation of the seaming chucks 13 and the support tables 14 causes the can ends X and the cans Y which are sandwiched by the seaming chucks 13 and the support tables 14 to rotate. During this time, the can end holder means 5 are rotated at all times through the meshing engagement between the pinion gears 32 and the first rack member 31*a*.

Then, the pinion gears 32 of the can end holder means 5 move out of mesh with the upstream first rack member 31*a* into mesh with the second rack member 31*b* and then with the downstream arcuate first rack member 31*a*. If a pinion gear 32 does not properly mesh with the second rack member 31*b*, then the second rack member 31*b* is pushed outwardly by the teeth of the pinion gear 32 as indicated by the imaginary lines in FIG. 13, resulting in angularly movement about the hinge pin 51 away from the pinion gear 32. The instant the teeth of the second rack 31*b* and the teeth of the pinion gear 32 are aligned for intermeshing engagement, the second rack member 31*b* is resiliently returned into smoothly joined relation to the first rack members 31*a*, and the pinion gear 32 is brought into mesh with the second rack member 31*b*. Consequently, the pinion gears 32 and the rack 31 are held in proper mesh with each other at all times, so that the can ends Y can be smoothly rotated.

Figure 14:
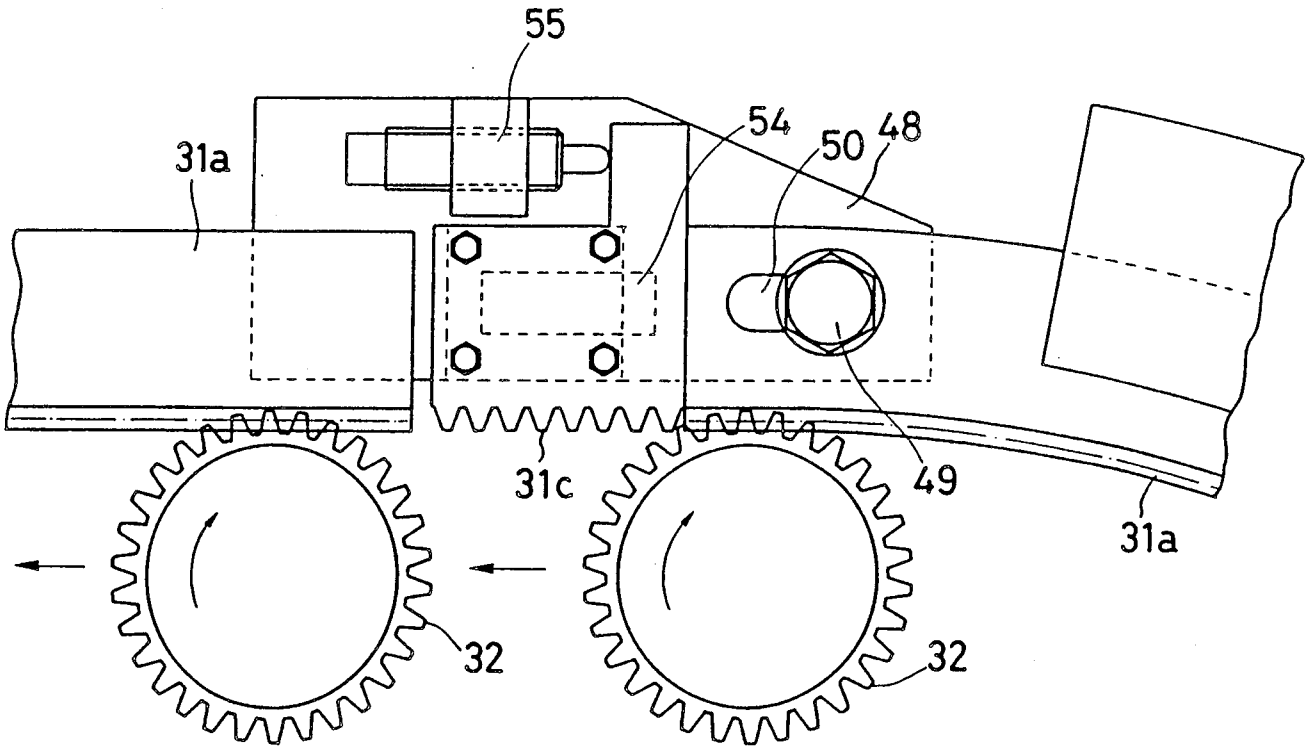
FIG. 14 is an enlarged plan view showing how a rotative drive means according to another embodiment operates.
Figure 15:
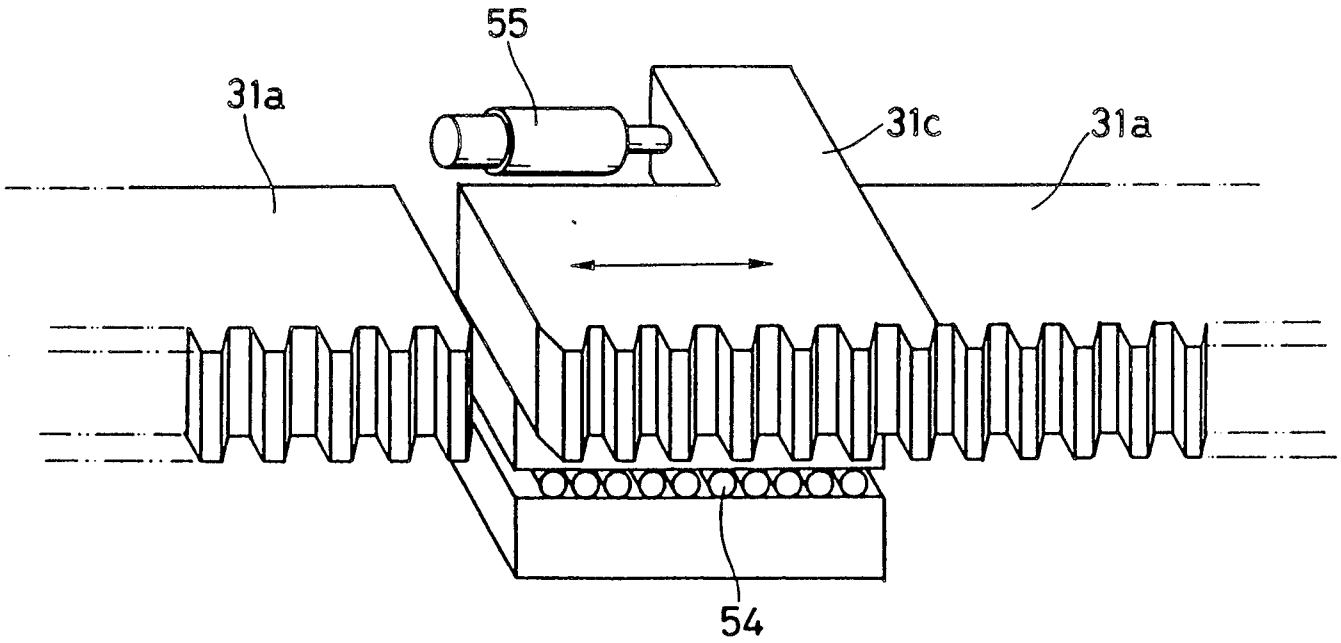
FIG. 15 is an enlarged fragmentary perspective view of the rotative drive means shown in FIG. 14.

FIGS. 14 and 15 illustrate a rotative drive means according to another embodiment of the present invention. In FIGS. 14 and 15, a second rack member 31*c* is disposed in each of the gaps between the first rack members 31*a*, the second rack member 31*c* being slidable downstream with respect to the direction in which the can end holder means 5 are movable, through a bearing 54. As shown in FIG. 14, the second rack member 31*c* is normally held against the arcuate first rack member 31*a* by a spring-biased plunger 55 which urges the second rack member 31*c* upstream. Therefore, the second rack member 31*c* is contiguous to the first rack members 31*a* and interconnects them. When a pinion gear 32 is to move along the second rack member 31*c*, the pinion gear 32 meshes out of the arcuate first mesh member 31*a* smoothly into mesh with the second rack member 31*c*. Since the second rack member 31*c* is movable by the bearing 54, but is not fixed in position, the second rack member 31c with which the pinion gear 32 meshes is moved, in the gap between the first rack members 31a, with the pinion gear 32. When the second rack member 31c engages the downstream first rack member 31a, the pinion gear 32 meshes out of the second rack member 31c into mesh with the downstream first rack member 31a. Upon the pinion gear 32 leaving the second rack member 31c, the second rack member 31c returns into the position held against the upstream arcuate first rack member 31a under the bias of the spring-biased plunger 55.

The pinion gears 32 are therefore held in mesh with the rack members 31a, 31c at all times, allowing the can ends to rotate smoothly.

Figure 16:
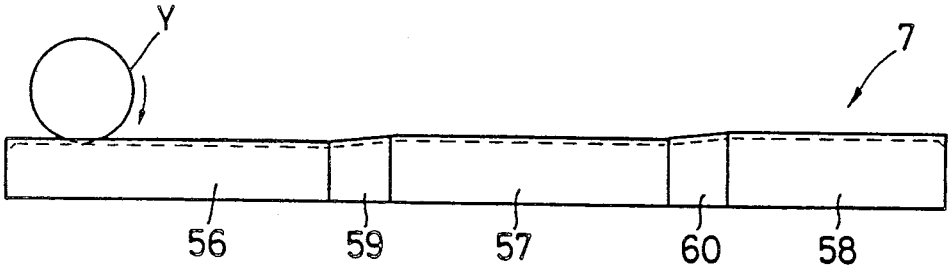
FIG. 16 is an enlarged plan view of a seaming means in the seaming apparatus shown in FIG. 1.

The first seaming means 7 will be described in detail below. As shown in FIG. 12, the first seaming means 7 is in the forward feed path along which the can holder means 10 are linearly arranged. The first seaming means 7 has first, second, and third straight seaming segments 56, 57, 58 (FIG. 16) each for seaming portions of cans and can ends to a certain degree. The degree to which the can and can end portions are seamed by the second seaming segment 57 is larger than the degree to which the can and can end portions are seamed by the first seaming segment 56. The degree to which the can and can end portions are seamed by the third seaming segment 58 is larger than the degree to which the can and can end portions are seamed by the second seaming segment 57. Between the first, second, and third seaming segments 56, 57, 58, there are disposed inclined seaming segments 59, 90 for guiding a can end Y to roll smoothly along the seaming segments 56, 57, 58 which are successively arranged stepwise. As shown in FIG. 16, the first seaming segment 56 is of such a length that the can end Y rolling therealong makes at least one revolution when it is fed linearly in its feeding direction, and serves to seam the can end Y to a constant degree fully circumferentially therearound. The second seaming segment 57 is joined to the first seaming segment 56 through the inclined seaming segment 59 and is of such a length that the can end Y rolling therealong makes at least one revolution when it is fed linearly in its feeding direction. The second seaming segment 57 serves to seam the can end Y to a constant degree greater than the first seaming segment 56, fully circumferentially therearound. The third seaming segment 58 is joined to the second seaming segment 57 through the inclined seaming segment 60 and is of such a length that the can end Y rolling therealong makes at least one revolution when it is fed linearly in its feeding direction. The third seaming segment 58 serves to seam the can end Y to a constant degree greater than the second seaming segment 57, fully circumferentially therearound.

Figure 17:
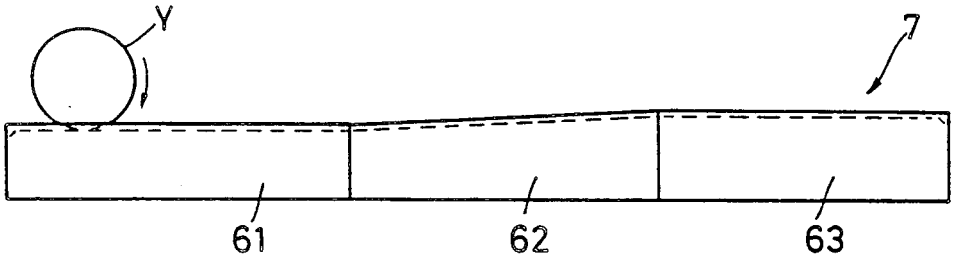
FIGS. 17 and 18 are enlarged plan views of seaming means in accordance with other embodiments of the present invention.

FIG. 17 shows a first seaming means 7 in accordance with another embodiment of the present invention. In FIG. 17, the first seaming means 7 comprises a first straight seaming segment 61, a second inclined seaming segment 62, and a third straight seaming segment 63, the seaming segments 61, 62, 63 being joined successively.

The first seaming segment 61 is of such a length that the can end Y rolling therealong makes at least one revolution when it is fed linearly in its feeding direction, and serves to seam the can end Y to a constant degree fully circumferentially therearound. The second seaming segment 62 is joined to the first seaming segment 61 and is of such a length that the can end Y rolling therealong makes at least one revolution when it is fed linearly in its feeding direction. The second seaming segment 62 serves to seam the can end Y to a degree which is progressively greater as the second seaming segment 62 becomes progressively closer to the can end Y. The third seaming segment 63 is joined to the second seaming segment 62 and is of such a length that the can end Y rolling therealong makes at least one revolution when it is fed linearly in its feeding direction. The third seaming segment 63 serves to seam the can end Y to a constant degree greater than the first seaming segment 61, fully circumferentially therearound. The degree to which the can end Y is seamed by the second seaming segment 62 is progressively greater since the inclined edge of the second seaming segment 62 applies a progressively greater pressure on the can end Y as the can end Y is fed in its feeding direction. As the can end Y is progressively seamed by the second seaming segment 62, the diameter of the can end Y is progressively reduced. The degree to which the can end Y is seamed is smaller and the diameter of the can end Y is larger at a seaming starting position of the second seaming segment 62, and the degree to which the can end Y is seamed is larger and the diameter of the can end Y is smaller at a seaming ending position on the second seaming segment 62. However, inasmuch as the can end Y has already been seamed by the first seaming segment 61 upstream of the second seaming segment 62, the difference between the different seaming degrees by the second seaming segment 62 is comparatively small. When the can end Y finally rolls onto the third seaming segment 63, the degree to which the can end Y is seamed is uniformized and the can end Y is seamed highly accurately by the third seaming segment 63.

Figure 18:
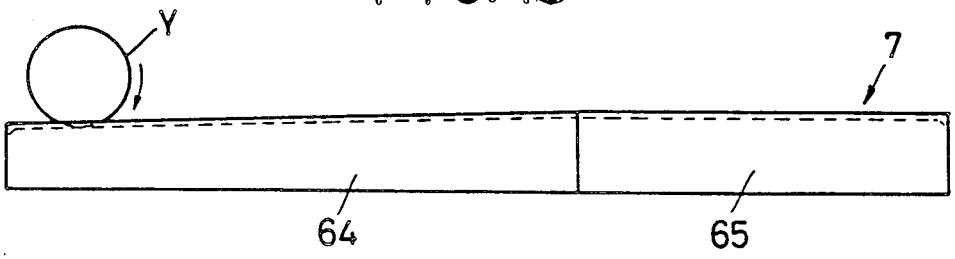

FIG. 18 shows still another first seaming means 7 for seaming a can end Y having a smaller diameter. The seaming means 7 shown in FIG. 18 comprises an inclined seaming segment 64 and a straight seaming segment 65. The inclined seaming segment 64 is of such a length that the can end Y rolling therealong makes at least one revolution when it is fed linearly in its feeding direction, and serves to seam the can end Y to a progressively larger degree fully circumferentially therearound. The straight seaming segment 65 is joined to the inclined seaming segment 64 and is of such a length that the can end Y rolling therealong makes at least one revolution when it is fed linearly in its feeding direction. The straight seaming segment 66 serves to seam the can end Y to a constant degree. The degree to which the can end Y is seamed by the inclined seaming segment 64 is different at seaming starting and ending points on the can end Y, but the can end Y is then uniformly seamed when it rolls on the straight seaming segment 65.

The second seaming means 8 will be described in detail below. As shown in FIG. 12, the second seaming means 8 is in the return feed path along which cans X are linearly fed by the can feed means 2.

The second seaming means 8 has a secondary seaming groove 8a and an engaging step or shoulder 8b extending downstream from a position where can ends Y are released from the second seaming means 8.

Figure 19:
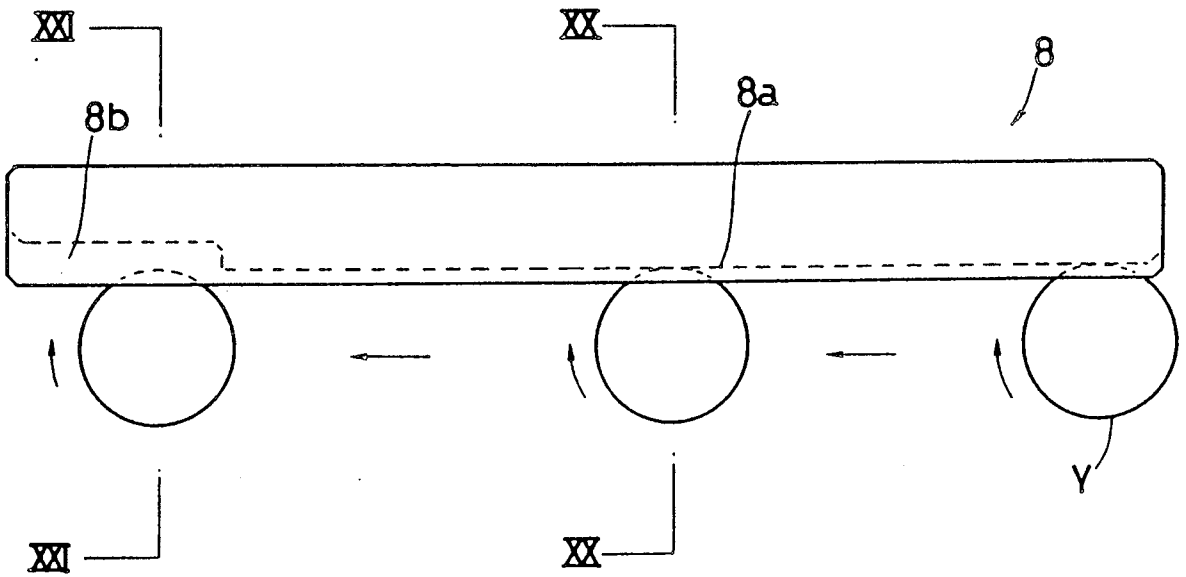
FIG. 19 is an enlarged plan view of another seaming means in the seaming apparatus shown in FIG. 1.
Figure 21:
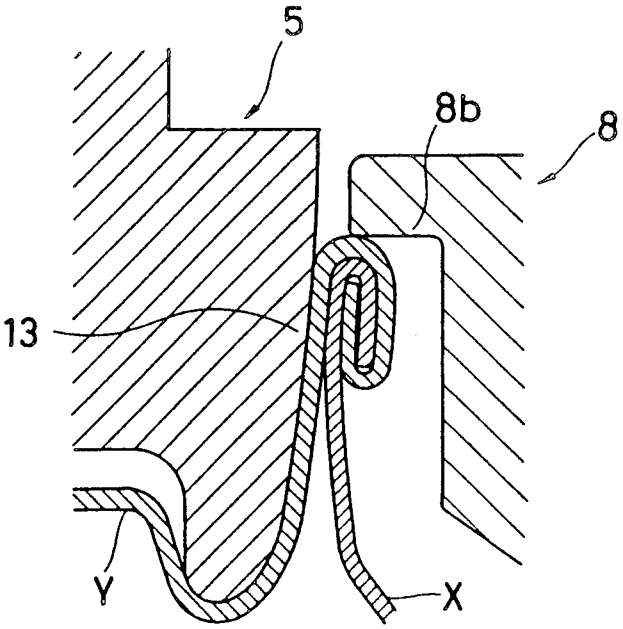
FIGS. 20 and 21 are enlarged cross-sectional views taken along line XX—XX and line XXI—XXI of FIG. 19.
Figure 20:
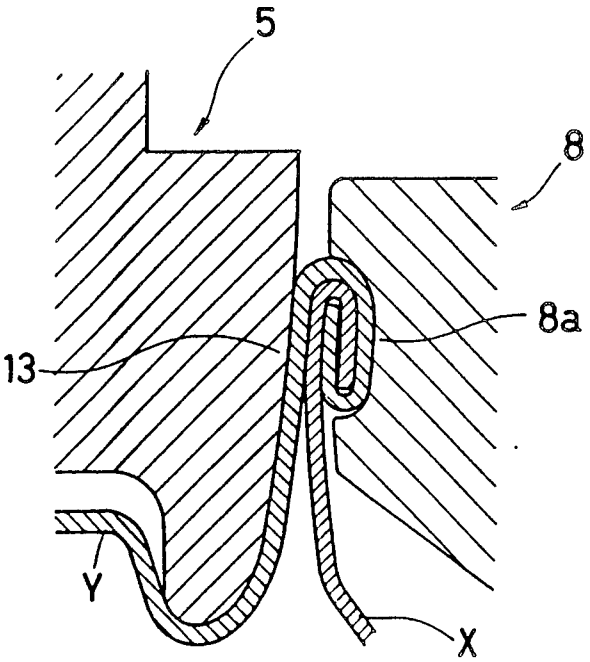
Figure 22:
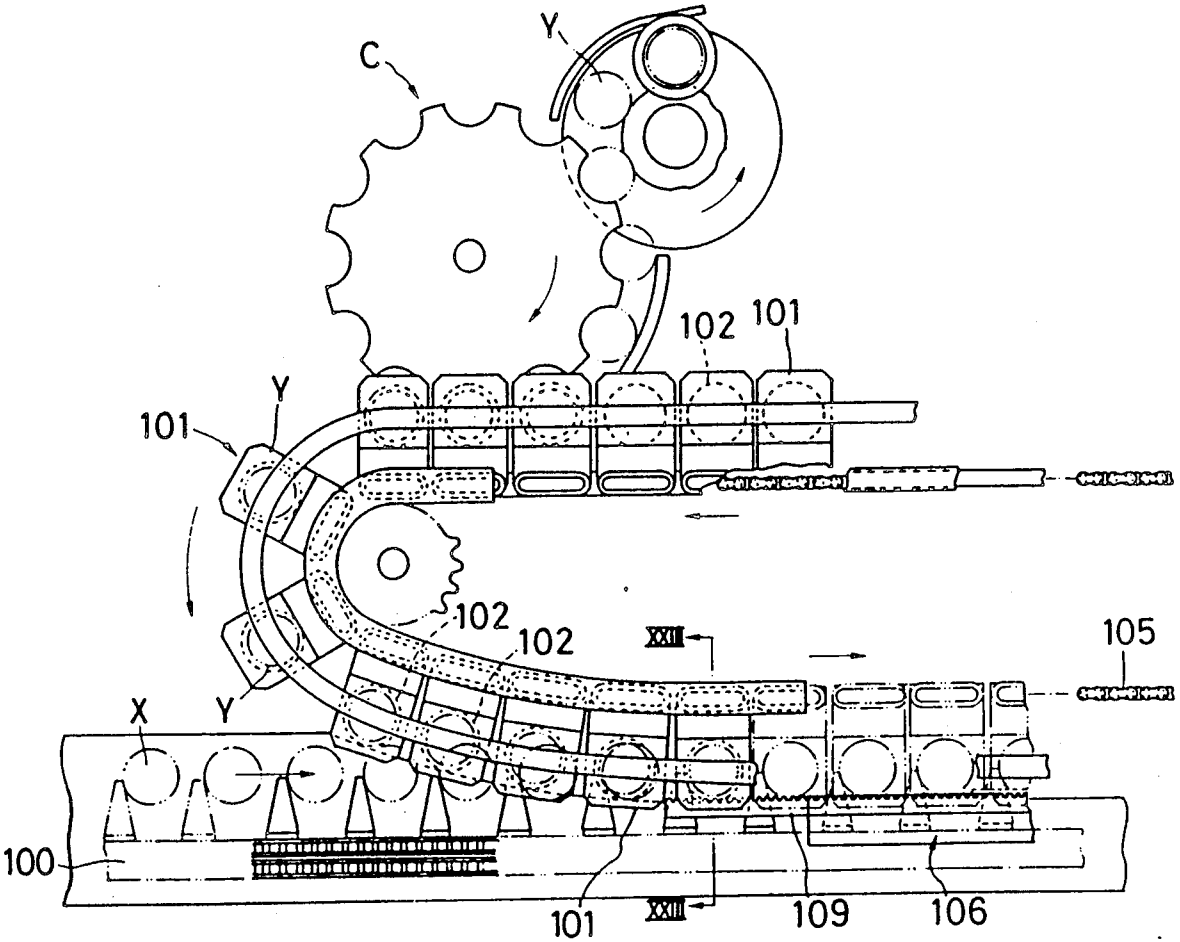
FIG. 22 PRIOR ART
FIG. 22 is a fragmentary plan view of a conventional seaming apparatus.
Figure 23:
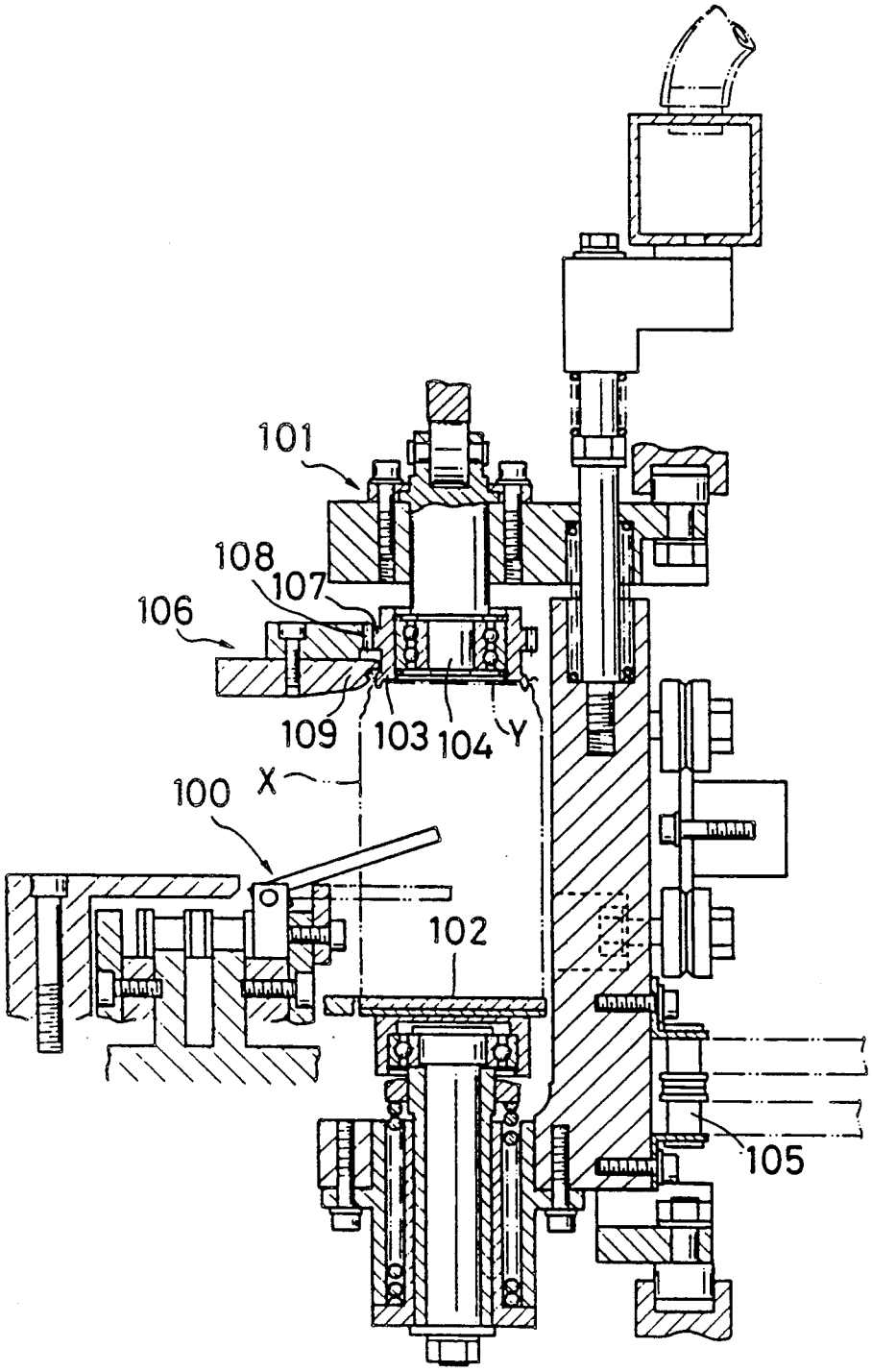
FIG. 23 PRIOR ART
FIG. 23 is a cross-sectional view taken along line XXIII—XXIII of FIG. 22.

As illustrated in FIGS. 19 through 21, a can end Y rolls on the second seaming means 8 while an upper edge of the cam end Y is being engaged by the engaging shoulder 8b. At the same time, the seaming chuck 13 which holds the can end Y starts being elevated with the guide roller 15 guided by the guide rail 12 until finally the seaming chuck 13 is released from the can end Y with its upper edge engaged by the engaging shoulder 8b. While the can X and the can end Y are being linearly fed by the can holder means 10 and the can end holder means 5, respectively, the can end Y is rotated and at the same time double-seamed as it is pressed and rolled in the groove 8*a* of the second seaming means 8, as shown in FIG. 20. Then, when the can end Y is moved out of the terminal end of the groove 8*a* and reaches the engaging shoulder 8*b*, the can end Y is released from pressed engagement with the can end holder means 5 as it is lifted.

With this arrangement, it is not necessary to employ a knockout pad or the like in the can end holder means 5 for releasing the can end holder means 5 from the can end Y, but it is possible to release the can end holder means 5 from the can end Y with a simple structure.

The seaming apparatus A thus constructed operates as follows:

Each of cans X is filled with contents by the filling apparatus B, and then clamped between front and rear attachments 21 of the first can feed means 1 and fed linearly as shown in FIG. 1.

Can ends Y are supplied successively from the can end supply means 5, and delivered from the can end supply turret 19 to the can end feed means 3. The supplied can ends Y are then attracted to the respective can end holder means 5.

Since the can end holder means 5 are associated respectively with the can holder means 10, the can end holder means 5 are moved with the can holder means 10 along the endless elliptical path by the endless chain 15. While the can holder means 10 are being moved along the endless path, each of the seaming chucks 13 is rotated and feeds one can end Y through meshing engagement between the rack 31 and the pinion gear 32 integral with the seaming chuck 13. Each of the can feed means 10 approaches the first can feed means 1 and then moves parallel thereto. One can X, which is fed by the first feed means 1 at this time, is transferred onto one support table 13 of the second can feed means 2 while being clamped between front and rear attachments 21. When the can X is completely transferred to the second can feed means 2, the attachments 21 are elevated out of clamping engagement with the can X.

Upon transfer of the can X onto the second can feed means 2, the corresponding can end holder means 5 is lowered by the guide rail 12 through the block 25 and the guide roller 15 until the can end Y held by the can end holder means 5 is placed over the opening of the can X on the support table 13.

When the can end holder means 5 and the can holder means 10 rotate and feed the can end Y and the can X, respectively, the seaming chuck 13 and the support table 14 are rotated in synchronism with the feeding of the can end Y and the can X, thereby rotating the can end Y and the can X. In the forward path of the second can feed means 2, the seaming chuck 13 and the support table 14 linearly feed the can end Y and the can X while rotating the same. At the same time, the end hook of the can end Y is pressed and rolled by the first seaming means 7, and seamed highly accurately successively by the first seaming segment 56, the second seaming segment 57, and the third seaming segment 58 of the first seaming means 7. The can end Y can be seamed at high speed because the pinion gear 32 integral with the seaming chuck 13 remains in mesh with the rack 31.

The can holder means 10 changes its direction and enters the arcuate path, and then enters the straight return path, with the pinion gear 32 rolling from the first rack member 31*a* onto the second rack member 31*b*. If the pinion gear 32 does not smoothly mesh with the second rack member 31*b*, then the second rack member 31*b* is angularly pushed outwardly by the pinion gear 32 and then springs back into smooth mesh with the pinion gear 32.

Thereafter, the can X and the can end Y, which are being sandwiched between the can end holder 5 and the support table 14, are fed linearly and simultaneously rotated, and at the same time pressed and rolled in the groove 3*a* of the second seaming means 8. As a result, the can end Y is double-seamed to the can X.

After the can end Y is fully seamed to the can X, the can end Y reaches the engaging shoulder 8*b* of the second seaming means 8. Concurrent with this, the guide roller 15 of the block 25 is guided by the guide rail 12 to cause the can end holder means 4 to ascend, thereby releasing the can end Y from intimate contact with the seaming chuck 13. The can X, which is held by the can holder means 10, with the can end Y seamed to the can X, is now released on the support table 14. Thereafter, the can X is removed from the second can feed means 2 by the discharge turret 22, and then discharged down the discharge chute 23.

Although certain preferred embodiments have been shown and described, it should be understood that many changes and modifications may be made therein without departing from the scope of the appended claims.

What is claimed is:

1. An apparatus for seaming a can end to a filled cylindrical can, comprising:

first can feed means for feeding the can linearly horizontally at a predetermined speed;

second can feed means for receiving the can from said first can feed means while supporting the can rotatably, said second can feed means being movable along a substantially elliptical path composed of a straight path and an arcuate path, for feeding the can along said substantially elliptical path;

can end feed means disposed above said second can feed means in confronting relation thereto and movable in synchronism with said second can feed means;

can end holder means for detachably holding the can end, said can end holder means being rotatably and vertically movably disposed in said can end feed means;

lifting/lowering means for lowering said can end holder means to place the can end held by said can end holder means against an open end of the can;

rotative drive means for rotating said can end holder means to rotate the can end and the can in unison with each other;

linear seaming means for pressing the can end to seam the same to the can while said second can feed means is being moved along said straight path; and said rotative drive means comprising a pinion gear coaxial and rotatable with said can end holder means and a rack meshing with said pinion gear and extending fully along said substantially elliptical path.

2. An apparatus according to claim 1, further comprising a drive sprocket, a driven sprocket, and an endless chain trained around said drive and driven sprockets, said second can feed means and said can end feed means being movable by said endless chain, said rack extending along said substantially elliptical path, said rack comprising two separate first rack members disposed in said straight path remotely from said linear seaming means and having teeth, and two second rack members disposed in gaps defined between said first rack members, said second rack members having teeth contiguous to the teeth of said first rack members, said second rack members being angularly movable about downstream ends thereof with respect to a direction in which said can end holder means is movable.

3. An apparatus according to claim 1, further comprising a drive sprocket, a driven sprocket, and an endless chain trained around said drive and driven sprockets, said second can feed means and said can end feed means being movable by said endless chain, said rack extending along said substantially elliptical path, said rack comprising two separate first rack members disposed in said straight path remotely from said linear seaming means and having teeth, and two second rack members disposed in gaps defined between said first rack members, said second rack members having teeth contiguous to the teeth of said first rack members, said second rack members being slidable downstream with respect to a direction in which said can end holder means is movable.

4. An apparatus according to claim 1, wherein said can end feed means includes a support shaft, said can end holder means being rotatably and detachably supported on said support shaft by a bearing.

5. An apparatus for seaming a can end to a filled cylindrical can, comprising:

first can feed means for feeding the can linearly horizontally at a predetermined speed;

second can feed means for receiving the can from said first can feed means while supporting the can rotatably, said second can feed means being movable along a substantially elliptical path composed of a straight path and an arcuate path, for feeding the can along said substantially elliptical path;

can end feed means disposed above said second can feed means in confronting relation thereto and movable in synchronism with said second can feed means;

can end holder means for detachably holding the can end, said can end holder means being rotatably and vertically movably disposed in said can end feed means;

lifting/lowering means for lowering said can end holder means to place the can end held by said can end holder means against an open end of the can;

rotative drive means for rotating said can end holder means to rotate the can end and the can in unison with each other;

linear seaming means for pressing the can end to seam the same to the can while said second can feed means is being moved along said straight path; and said linear seaming means comprising an inclined seaming segment for seaming the can end to a progressively greater degree, said inclined seaming segment having such a length to allow the can end to make at least one revolution in a direction in which the can end is fed, and a straight seaming segment for seaming the can end to a constant degree, said straight seaming segment being joined to said inclined seaming segment and having such a length to allow the can end to make at least one revolution.

6. An apparatus for seaming a can end to a filled cylindrical can, comprising:

first can feed means for feeding the can linearly horizontally at a predetermined speed;

second can feed means for receiving the can from said first can feed means while supporting the can rotatably, said second can feed means being movable along a substantially elliptical path composed of a straight path and an arcuate path, for feeding the can along said substantially elliptical path;

can end feed means disposed above said second can feed means in confronting relation thereto and movable in synchronism with said second can feed means;

can end holder means for detachably holding the can end, said can end holder means being rotatably and vertically movably disposed in said can end feed means;

lifting/lowering means for lowering said can end holder means to place the can end held by said can end holder means against an open end of the can;

rotative drive means for rotating said can end holder means to rotate the can end and the can in unison with each other;

linear seaming means for pressing the can end to seam the same to the can while said second can feed means is being moved along said straight path; and said linear seaming means comprising a first straight seaming segment for seaming the can end to a constant degree, said first straight seaming segment having such a length to allow the can end to make at least one revolution in a direction in which the can end is fed, and a second straight seaming segment for seaming the can end to a constant degree greater than said constant degree by said first straight seaming segment, said second straight seaming segment having such a length as to allow the can end to make at least one revolution, and an inclined seaming segment for seaming the can end to a progressively greater degree, said inclined seaming segment being disposed between and interconnecting said first and second straight seaming segments and having such a length to allow the can end to make at least one revolution.

7. An apparatus for seaming a can end to a filled cylindrical can, comprising:

first can feed means for feeding the can linearly horizontally at a predetermined speed;

second can feed means for receiving the can from said first can feed means while supporting the can rotatably, said second can feed means being movable along a substantially elliptical path composed of a straight path and an arcuate path, for feeding the can along said substantially elliptical path;

can end feed means disposed above said second can feed means in confronting relation thereto and movable in synchronism with said second can feed means;

can end holder means for detachably holding the can end, said can end holder means being rotatably and vertically movably disposed in said can end feed means;

lifting/lowering means for lowering said can end holder means to place the can end held by said can end holder means against an open end of the can;

rotative drive means for rotating said can end holder means to rotate the can end and the can in unison with each other;

linear seaming means for pressing the can end to seam the same to the can while said second can feed means is being moved along said straight path; and said linear seaming means comprising a first straight seaming segment for seaming the can end to a constant degree, said first straight seaming segment having such a length to allow the can end to make at least one revolution in a direction in which the can end is fed, and a second straight seaming segment for seaming the can end to a constant degree greater than said constant degree by said first straight seaming segment, said second straight seaming segment having such a length as to allow the can end to make at least one revolution, and an inclined seaming segment for guiding the can end, said inclined seaming segment being disposed between and interconnecting said first and second straight seaming segments.

8. An apparatus for seaming a can end to a filled cylindrical can, comprising:

first can feed means for feeding the can linearly horizontally at a predetermined speed;

second can feed means for receiving the can from said first can feed means while supporting the can rotatably, said second can feed means being movable along a substantially elliptical path composed of a straight path and an arcuate path, for feeding the can along said substantially elliptical path;

can end feed means disposed above said second can feed means in confronting relation thereto and movable in synchronism with said second can feed means;

can end holder means for detachably holding the can end, said can end holder means being rotatably and vertically movably disposed in said can end feed means;

lifting/lowering means for lowering said can end holder means to place the can end held by said can end holder means against an open end of the can;

rotative drive means for rotating said can end holder means to rotate the can end and the can in unison with each other;

linear seaming means for pressing the can end to seam the same to the can while said second can feed means is being moved along said straight path;

said linear seaming means including an engaging portion, disposed downstream of a position where the can seam is completely seamed by said linear seaming means, for engaging an upper edge of the can end; and means for elevating said can end holder means out of engagement with the can end when the can end has moved past said engaging portion.

9. An apparatus for seaming a can end to a filled cylindrical can, comprising:

first can feed means for feeding the can linearly horizontally at a predetermined speed;

second can feed means for receiving the can from said first can feed means while supporting the can rotatably, said second can feed means being movable along a substantially elliptical path composed of a straight path and an arcuate path, for feeding the can along said substantially elliptical path;

can end feed means disposed above said second can feed means in confronting relation thereto and movable in synchronism with said second can feed means;

can end holder means for detachably holding the can end, said can end holder means being rotatably and vertically movably disposed in said can end feed means;

lifting/lowering means for lowering said can end holder means to place the can end held by said can end holder means against an open end of the can;

rotative drive means for rotating said can end holder means to rotate the can end and the can in unison with each other;

linear seaming means for pressing the can end to seam the same to the can while said second can feed means is being moved along said straight path;

a support on which said second can feed means is mounted;

an elongate member fixed to said support and extending along the height of the can, said can end feed means being vertically movably supported on said elongate member;

a guide member mounted on said can end feed means;

a guide rail for causing said guide member to vertically move said can end feed means between a position in which the can end is placed against the open end of the can and a position in which said can end holder means is released from the can end, said guide rail being vertically movable and extending along the direction in which the can end is fed by said can end feed means; and adjusting means for vertically moving said guide rail to adjust the vertical position thereof.

10. An apparatus according to claim 9, further comprising a drive sprocket, a driven sprocket, and an endless chain trained around said drive and driven sprockets, said can end feed means being connected to said endless chain through said elongate member and angularly movable by said endless chain.

11. An apparatus for seaming a can end to a filled cylindrical can, comprising:

first can feed means for feeding the can linearly horizontally at a predetermined speed;

second can feed means for receiving the can from said first can feed means while supporting the can rotatably, said second can feed means being movable along a substantially elliptical path composed of a straight path and an arcuate path, for feeding the can along said substantially elliptical path;

can end feed means disposed above said second can feed means in confronting relation thereto and movable in synchronism with said second can feed means;

can end holder means for detachably holding the can end, said can end holder means being rotatably and vertically movably disposed in said can end feed means;

lifting/lowering means for lowering said can end holder means to place the can end held by said can end holder means against an open end of the can;

rotative drive means for rotating said can end holder means to rotate the can end and the can in unison with each other;

linear seaming means for pressing the can end to seam the same to the can while said second can feed means is being moved along said straight path;

a support on which said second can feed means is mounted;

an elongate member fixed to said support and extending along the height of the can, said can end feed means being vertically movably supported on said elongate member;

a support shaft vertically slidably mounted on said can end feed means, said can end holder means being rotatably mounted on a lower end of said support shaft;

a first guide member mounted on said can end feed means;

a first guide rail for causing said first guide member to hold said can end feed means in a predetermined vertical position and guide said can end feed means, said first guide rail being vertically movable and extending along the direction in which the can end is fed by said can end feed means;

a second guide member mounted on said support shaft;

a second guide rail for causing said second guide member to vertically move said can end holder means between a position in which the can end is placed against the open end of the can and a position in which said can end holder means is released from the can end, said second guide rail being vertically movable and extending along the direction in which the can end is fed by said can end feed means; and adjusting means for vertically moving said first and second guide rails to adjust the vertical position thereof.

12. An apparatus according to claim 11, further comprising a drive sprocket, a driven sprocket, and an endless chain trained around said drive and driven sprockets, said second can feed means and said can end feed means being connected to said endless chain through said elongate member and angularly movable by said endless chain.

13. An apparatus according to claim 11, further including a common member on which said first and second guide rails are disposed.

* * * * *